US007604319B2

(12) United States Patent
Hirakawa

(10) Patent No.: US 7,604,319 B2
(45) Date of Patent: Oct. 20, 2009

(54) IMAGE FORMING APPARATUS

(75) Inventor: Takashi Hirakawa, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 291 days.

(21) Appl. No.: 11/493,837

(22) Filed: Jul. 27, 2006

(65) Prior Publication Data

US 2007/0024648 A1 Feb. 1, 2007

(30) Foreign Application Priority Data

Jul. 28, 2005 (JP) ..... 2005-219222

(51) Int. Cl.
*B41J 2/015* (2006.01)

(52) U.S. Cl. ..... 347/21

(58) Field of Classification Search ..... 347/7, 347/21

See application file for complete search history.

(56) References Cited

U.S. PATENT DOCUMENTS

| | | | | |
|---|---|---|---|---|
| 4,538,160 | A | 8/1985 | Uchiyama | |
| 6,102,537 | A * | 8/2000 | Kato et al. | 347/101 |
| 2002/0145642 | A1 * | 10/2002 | Kitakami | 347/40 |
| 2004/0201656 | A1 | 10/2004 | Koitabashi et al. | |

FOREIGN PATENT DOCUMENTS

| | | | |
|---|---|---|---|
| EP | 0 726 158 | A1 | 8/1996 |
| JP | 58-128862 | A | 8/1983 |
| JP | 11-129461 | A | 5/1999 |
| JP | 2002-337332 | A | 11/2002 |

* cited by examiner

*Primary Examiner*—Matthew Luu
*Assistant Examiner*—Justin Seo
(74) *Attorney, Agent, or Firm*—Birch, Stewart, Kolasch & Birch, LLP

(57) ABSTRACT

The image forming apparatus comprises: a liquid deposition device which deposits a first liquid of a treatment liquid on a recording medium initially, deposits a second liquid of an ink liquid including a coloring material on the recording medium secondly, and deposits a third liquid of a treatment liquid on the recording medium thirdly, in such a manner that the coloring material in the ink liquid is insolubilized on the recording medium and an image is formed on the recording medium; and a liquid deposition control device controlling the liquid deposition device in such a manner that a deposition volume per pixel of the first liquid, V1_Pixel, is smaller than a deposition volume per pixel of the second liquid, V2_Pixel, and a deposition surface area of the first liquid on the recording medium is greater than a deposition surface area of the second liquid on the recording medium.

6 Claims, 14 Drawing Sheets

SPREADING OF TREATMENT LIQUID WHEN DEPOSITED INDEPENDENTLY ON RECORDING MEDIUM

INK DEPOSITION SURFACE AREA (PREDICTED)

INK DEPOSITION SURFACE AREA (PREDICTED)
< TREATMENT LIQUID DEPOSITION SURFACE AREA

TREATMENT LIQUID IS DEPOSITED ON THE RECORDING MEDIUM TO A SURFACE AREA EQUAL TO OR GREATER THAN THE DEPOSITION SURFACE AREA OF INK

IF THE VOLUME OF THE TREATMENT LIQUID OF THE FIRST LIQUID IS TOO LARGE

IF THE VOLUME OF THE TREATMENT LIQUID OF THE FIRST LIQUID IS TOO SMALL

IMAGE FORMING APPARATUS

BACKGROUND OF THE INVENTION

1. Field of the Invention

The present invention relates to an image forming apparatus, and more particularly, to an image forming apparatus which deposits ink and a treatment liquid on a recording medium in such a manner that ink is caused to react with the treatment liquid to form an image.

2. Description of the Related Art

In an inkjet type of image forming apparatus, an image is formed on a recording medium by depositing ink from nozzles onto a recording medium while a head in which a plurality of nozzles are arranged and a recording medium are moved relatively with respect to each other.

Regarding an image forming apparatus of this kind, technology is known in which a treatment liquid that insolubilizes (aggregates) the coloring material contained in the ink by reacting with the ink is used in order to improve image quality, water resistance, and hardness. By depositing this treatment liquid on the recording medium in combination with the ink, the ink is fixed onto the recording medium.

Japanese Patent Application Publication No. 11-129461 discloses technology relating to a recording method by which a treatment liquid is deposited after a prescribed volume of ink has permeated into the recording medium, thereby causing reaction of the treatment liquid and the ink within a prescribed range of permeation.

Furthermore, Japanese Patent Application Publication No. 2002-337332 discloses technology relating to an inkjet printer where the equal amount of the treatment liquid is applied evenly by two separate actions, in order to resolve the problem of the difference in quality arising when printing is performed bi-directionally, between a case where the ink is deposited after depositing the treatment liquid, and a case where the treatment liquid is deposited after depositing the ink.

Moreover, Japanese Patent Application Publication No. 58-128862 discloses an inkjet recording method by which ink is deposited after depositing a treatment liquid, subsequently treatment liquid is newly deposited. Hence, the fixing properties and the permeability of the ink can be adjusted, and a protective layer is provided.

According to the invention described in Japanese Patent Application Publication No. 11-129461, so-called "ink ejection first" technology is used in which ink is ejected first, and then treatment liquid is ejected; however, since the treatment liquid is deposited after a prescribed volume of the ink deposited on the recording medium has permeated into the recording medium, then there is a possibility in that image deterioration, such as feathering, is liable to occur.

According to the invention described in Japanese Patent Application Publication No. 2002-337332, ink is deposited after treatment liquid is deposited first, and then treatment liquid is deposited again. In addition, Japanese Patent Application Publication No. 2002-337332 states that, regardless of whether a large or small volume of treatment liquid is deposited initially, image deterioration can occur, and hence it is desirable if half of a prescribed quantity of treatment liquid is deposited each time. However, Japanese Patent Application Publication No. 2002-337332 does not describe the volume of treatment liquid with respect to the ink.

If the volume of treatment liquid deposited initially is too large compared to the volume of ink, then although spreading of the ink on the recording medium is suppressed, the coloring material in the ink becomes a floating state in the vicinity of the center of the treatment liquid deposited onto the recording medium, as shown in FIGS. 13A to 13C, and hence the coloring material becomes separated from the recording medium. Therefore, the coloring material in the ink becomes insoluble without making contact with the recording medium, and hence the fixing of the coloring material to the recording medium is insufficient. Consequently, the coloring material becomes an instable state in the treatment liquid, and a possibility arises in that the image formed on the recording medium can be disrupted by external disturbances, such as impacts occurring during conveyance of the recording medium, or the like.

On the other hand, if the volume of treatment liquid deposited initially is too small, then the deposition surface area of the treatment liquid on the recording medium becomes insufficient, as shown in FIGS. 14A to 14C, and if ink is deposited onto the recording medium in this state, then the ink that does not react with the treatment liquid spreads horizontally over the surface of the recording medium, thus giving rise to feathering.

Japanese Patent Application Publication No. 58-128862 makes no mention of the volume of treatment liquid with respect to the ink.

SUMMARY OF THE INVENTION

The present invention is contrived in view of these circumstances, an object thereof being to provide an image forming apparatus which adopts a deposition method for the treatment liquid whereby the ink can be stably fixed on the recording medium and the image quality can be improved.

In order to attain the aforementioned object, the present invention is directed to an image forming apparatus, comprising: a liquid deposition device which deposits a first liquid of a treatment liquid on a recording medium initially, deposits a second liquid of an ink liquid including a coloring material on the recording medium secondly, and deposits a third liquid of a treatment liquid on the recording medium thirdly, in such a manner that the coloring material in the ink liquid is insolubilized on the recording medium and an image is formed on the recording medium; and a liquid deposition control device controlling the liquid deposition device in such a manner that a deposition volume per pixel of the first liquid, V1_Pixel, is smaller than a deposition volume per pixel of the second liquid, V2_Pixel, and a deposition surface area of the first liquid on the recording medium is greater than a deposition surface area of the second liquid on the recording medium.

According to this aspect of the present invention, the deposition volume V1_Pixel per pixel of the treatment liquid of the first liquid is smaller than the deposition volume V2_Pixel per pixel of the ink of the second liquid, and therefore it is possible to make the ink react in the vicinity of the surface of the recording medium. Accordingly, the ink can be made to adhere stably to the recording medium, without the ink coloring material floating up in the treatment liquid.

Furthermore, the deposition surface area of the treatment liquid of the first liquid on the recording medium is greater than the deposition surface area of the ink of the second liquid on the recording medium, and accordingly feathering can be prevented.

Moreover, the treatment liquid is deposited twice on the recording medium and caused to react with the ink twice, by means of the first liquid and the third liquid. Therefore it is possible to make the ink react rapidly and completely.

The "pixel" referred to in the present specification is the minimum unit which constitutes an image. The greater the number of pixels, the larger the amount of color and light information that can be recorded, and hence the clearer the image quality obtained. The volume of liquid (ink or treatment liquid) deposited within the range demarcated for one pixel is defined as the "deposition volume per pixel" of the liquid.

Furthermore, in the present specification, the term "deposition" used when an image is formed on a recording medium, includes: a mode where liquid is ejected (in the form of a droplet) from a nozzle toward a recording medium, and this liquid is deposited on the recording medium, as in an inkjet type image forming apparatus; and a mode where liquid is applied to a recording medium by means of an application roller, or the like, thereby depositing the liquid onto the recording medium.

Preferably, the liquid deposition control device controls the liquid deposition device in such a manner that a deposition volume per pixel of the third liquid, V3_Pixel, is greater than the deposition volume per pixel of the first liquid, V1_Pixel.

According to this aspect of the present invention, the liquid deposition control device implements control whereby the deposition volume per pixel of the third liquid, V3_Pixel, is greater than the deposition volume per pixel of the first liquid, V1_Pixel, and therefore, a sufficient amount of the treatment liquid of the third liquid is deposited and the ink is made to react rapidly and completely. Consequently, the coloring material in the ink deposited on the recording medium can be insolubilized completely, in a short period of time.

In order to attain the aforementioned object, the present invention is also directed to an image forming apparatus, comprising: a liquid deposition device which ejects a first liquid of a treatment liquid onto a recording medium initially, ejects a second liquid of an ink liquid including a coloring material onto the recording medium secondly, and ejects a third liquid of a treatment liquid onto the recording medium thirdly, in such a manner that the coloring material in the ink liquid is insolubilized on the recording medium and an image is formed on the recording medium; and a liquid deposition control device controlling the liquid deposition device in such a manner that a droplet ejection volume of the first liquid, V1, is smaller than a droplet ejection volume of the second liquid, V2, and a deposition surface area of the first liquid on the recording medium is greater than a deposition surface area of the second liquid on the recording medium.

According to this aspect of the invention, the droplet ejection volume V1 of the treatment liquid of the first liquid is smaller than the droplet ejection volume V2 of the ink of the second liquid, and therefore it is possible to cause the ink to react in the vicinity of the surface of the recording medium. Consequently, the ink can be made to adhere stably to the recording medium, without the ink coloring material floating up in the treatment liquid.

Furthermore, the deposition surface area, on the recording medium, onto which a droplet of the treatment liquid of the first liquid is ejected, is greater than the deposition surface area of the second liquid, and therefore feathering can be prevented.

Moreover, the treatment liquid is deposited twice on the recording medium and caused to react with the ink twice, by means of the first liquid and the third liquid. Therefore it is possible to make the ink react rapidly and completely.

The term "droplet ejection" here indicates a mode where a liquid is ejected (ejected as a droplet) from a nozzle, toward a recording medium, as in an inkjet type of image forming apparatus.

Preferably, the liquid droplet ejection control device controls the liquid deposition device in such a manner that a droplet ejection volume of the third liquid, V3, is greater than the droplet ejection volume of the first liquid, V1.

According to this aspect of the present invention, the liquid droplet ejection control device implements control whereby the droplet ejection volume V3 of the third liquid is greater than the droplet ejection volume V1 of the first liquid, and therefore a sufficient amount of the treatment liquid of the third liquid is deposited, and the ink is made to react rapidly and completely. Consequently, the coloring material in the ink deposited on the recording medium can be insolubilized completely, in a short period of time.

Preferably, surface tension of the third liquid, $\gamma$3, is smaller than surface tension of the second liquid, $\gamma$2.

According to this aspect of the present invention, the surface tension $\gamma$3 of the third liquid is smaller than the surface tension $\gamma$2 of the second liquid, and therefore it is possible to deposit the treatment liquid of the third liquid in a superimposed fashion so that the treatment liquid encompasses the ink of the second liquid. Therefore, good image quality can be achieved.

Preferably, surface tension of the first liquid, $\gamma$1, is smaller than surface tension of the second liquid, $\gamma$2.

According to this aspect of the present invention, the surface tension $\gamma$1 of the first liquid is smaller than the surface tension $\gamma$2 of the second liquid, and therefore it is possible to cause the ink to react in a state where the treatment liquid having low surface tension encloses the ink around the perimeter of the ink. Furthermore, it is also possible to sufficiently increase the deposition surface area of the treatment liquid on the recording medium. Therefore, it is possible to achieve good image quality, readily.

In order to attain the aforementioned object, the present invention is also directed to an image forming apparatus, comprising: a liquid deposition device which deposits a first liquid of a treatment liquid on a recording medium initially, deposits a second liquid of an ink liquid including a coloring material on the recording medium secondly, and deposits a third liquid of a treatment liquid on the recording medium thirdly, in such a manner that the coloring material in the ink liquid is insolubilized on the recording medium and an image is formed on the recording medium; and a liquid deposition control device controlling the liquid deposition device in such a manner that a deposition volume per pixel of the second liquid, V2_Pixel, is greater than a residual volume per pixel of the first liquid, W1_Pixel, and that a deposition surface area of the first liquid on the recording medium is greater than a deposition surface area of the second liquid on the recording medium.

According to this aspect of the present invention, the deposition volume per pixel of the ink of the second liquid, V2_Pixel, is greater than the residual volume per pixel of the treatment liquid of the first liquid, W1_Pixel, and therefore the ink can be made to react in the vicinity of the surface area of the recording medium. Consequently, the ink can be made to adhere stably to the recording medium, without the ink coloring material floating up in the treatment liquid.

Furthermore, the deposition surface area, on the recording medium, of the treatment liquid of the first liquid is greater than the deposition surface area of the ink of the second liquid, and therefore feathering can be prevented.

Moreover, the treatment liquid is deposited twice on the recording medium and caused to react with the ink twice, by means of the first liquid and the third liquid. Therefore it is possible to make the ink react rapidly and completely.

The term "residual volume of treatment liquid" here indicates the volume of treatment liquid remaining on the recording medium in liquid form.

If the recording medium is a permeable medium, then permeation into the recording medium starts immediately after the initially deposited treatment liquid lands on the recording medium, and treatment liquid which has not yet permeated remains on the recording medium in the form of a liquid. On the other hand, if the recording medium is a non-permeable medium, then the initially deposited treatment liquid remains on the recording medium, rather than permeating into the recording medium, and the volume of this treatment liquid decreases as a result of evaporation, or the like. The term "the residual volume of treatment liquid" here includes the volume of treatment liquid remaining on the recording medium, in the case of a permeable medium and a non-permeable medium.

Here, a permeable medium and a non-permeable medium are used as classifications of media, by designating as "non-permeable" any recording medium in which the permeation speed of a prescribed liquid per prescribed surface area of the recording medium is equal to or lower than a prescribed threshold value, and by designating as "permeable" any recording medium having a permeation speed exceeding this threshold value. In other words, any recording medium in which the permeation time of a prescribed liquid per prescribed surface area of the recording medium is greater than a prescribed threshold value is classified as a "non-permeable" medium, and any recording medium having a permeation time equal to or less than this threshold value is classified as a "permeable" medium.

Preferably, the liquid deposition control device controls the liquid deposition device in such a manner that a deposition volume per pixel of the third liquid, V3_Pixel, is greater than the residual volume per pixel of the first liquid, W1_Pixel.

According to this aspect of the present invention, the liquid deposition control device implements control whereby the deposition volume per pixel of the third liquid, V3_Pixel, is greater than the residual volume per pixel of the treatment liquid of the first liquid, W1_Pixel, and therefore, a sufficient amount of the treatment liquid of the third liquid is deposited and the ink is made to react rapidly and completely. Consequently, the coloring material in the ink deposited on the recording medium can be insolubilized completely, in a short period of time.

Preferably, the liquid deposition control device controls the liquid deposition device in such a manner that the deposition volume per pixel of the second liquid, V2_Pixel, is greater than the residual volume per pixel of the first liquid, W1_Pixel, the deposition surface area of the first liquid on the recording medium is greater than the deposition surface area of the second liquid on the recording medium, and the deposition volume per pixel of the third liquid, V3_Pixel, is greater than the residual volume per pixel of the first liquid, W1_Pixel, even when the first liquid has permeated completely into the recording medium and the residual volume per pixel of the first liquid, W1_Pixel, is zero.

According to this aspect of the present invention, the liquid deposition control device performs control even in a state where the residual volume of treatment liquid W1_Pixel=0, namely, a state where the first liquid has permeated completely into the recording medium. Therefore it includes a case where ink is deposited after all of the treatment liquid of the first liquid has permeated inside a recording medium that is a permeable medium.

Here, the ink may be a dye-based ink in which a coloring material is dissolved in a liquid solvent in a molecular state (or an ion state), or a pigment-based ink in which a coloring material is dispersed in a liquid solvent in a state of very fine lumps, or the like. In other words, the coloring material contained in the ink may be a material which is dissolved in a liquid solvent in a molecular state (or in an ion state), or a material which is dispersed in a liquid solvent in the state of very fine lumps.

On the other hand, the treatment liquid is a liquid which acts so as to get out of the state of dissolution or dispersion of the coloring material in the ink in the liquid solvent, in such a manner that the coloring material is separated from the solvent.

More specifically, examples of the treatment liquid include: a "treatment liquid which causes the coloring material in the ink to separate from the solvent by precipitating or insolubilizing the coloring material in the ink by reacting with the ink", and a "treatment liquid which causes the coloring material in the ink to separate from the solvent by generating a semi-solid material (gel) which includes the coloring material of the ink", and the like.

In this way, the term "desolubilize" is used to describe the get-out of the state of dissolution or dispersal of the coloring material in the ink, in the liquid solvent, by means of an action of a treatment liquid on the ink.

According to the present invention, the ink is made to react in the vicinity of the surface of the recording medium, and therefore it is possible to fix the ink completely to the recording medium. Furthermore, it is also possible to prevent feathering by making the deposition surface area of the treatment liquid greater than the deposition surface area of the ink, and furthermore, a sufficient amount of treatment liquid is deposited and hence the ink can be made to react rapidly and completely. Consequently, it is possible to improve image quality by causing the ink to become fixed stably on the recording medium.

BRIEF DESCRIPTION OF THE DRAWINGS

The nature of this invention, as well as other objects and benefits thereof, are explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
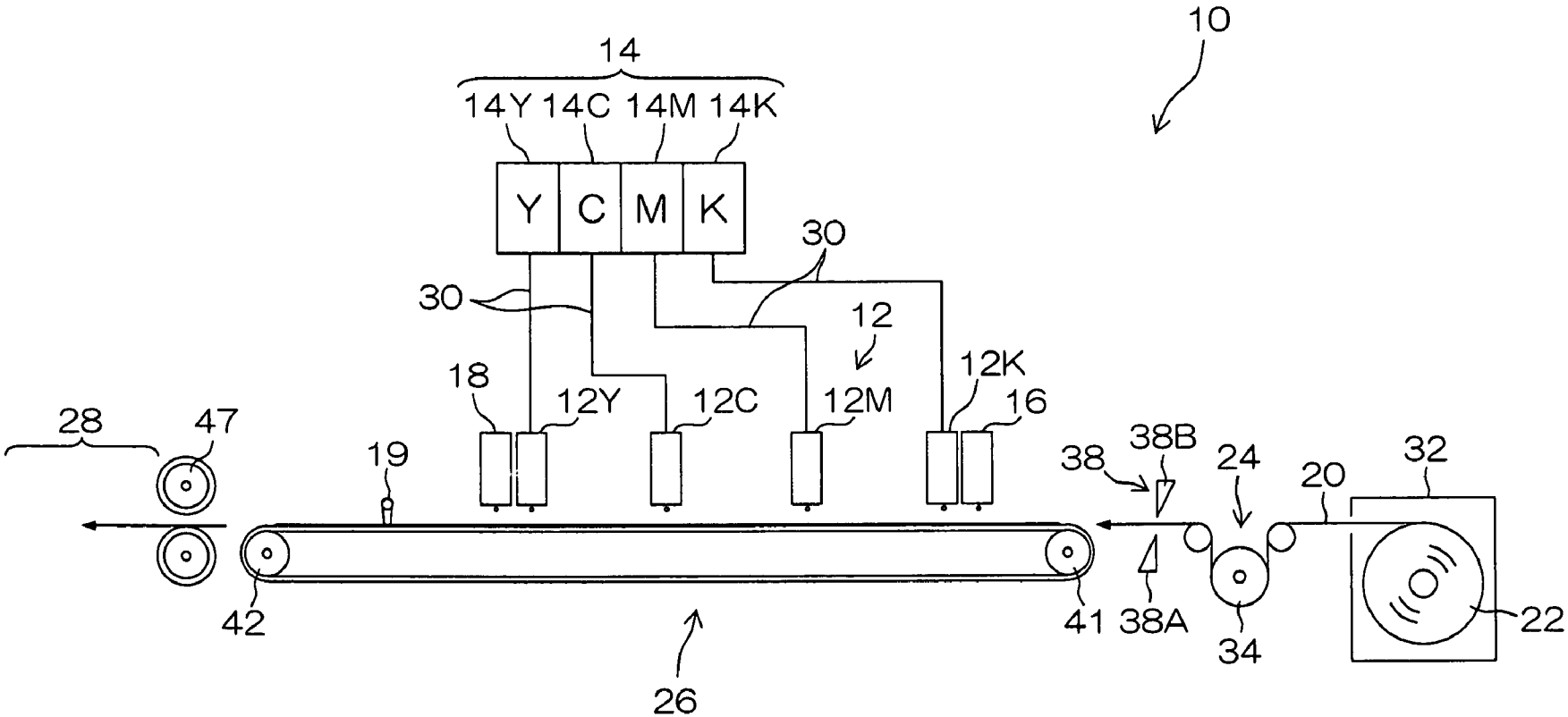
FIG. 1 is a general schematic drawing of an inkjet recording apparatus according to an embodiment of the present invention.

FIG. 1 is a general schematic drawing showing an inkjet recording apparatus forming an image forming apparatus according to a first embodiment of the present invention. As shown in FIG. 1, this inkjet recording apparatus 10 chiefly comprises: a plurality of print heads 12 (12K, 12M, 12C and 12Y) provided corresponding to respective ink colors; an ink storing and loading unit 14 which stores ink to be supplied to the respective print heads 12K, 12M, 12C and 12Y; treatment liquid droplet ejection heads 16 and 18; a post-drying unit 19 disposed on the downstream side of the print head 12Y (after the print head 12Y) in terms of the paper conveyance direction (the leftward direction in FIG. 1); a recording medium supply unit 22 for supplying recording medium (media) 20; a decurling unit 24 for removing curl from the recording medium 20; a conveyance unit 26 disposed facing the nozzle surface (ink ejection surface) of the print heads 12K, 12M, 12C and 12Y, for conveying the recording medium 20 while keeping the media 20 flat; and a paper output unit 28 for outputting recorded paper (printed matter) to the exterior.

The ink storing and loading unit 14 has ink tanks for storing the inks of K, C, M and Y to be supplied to the print heads 12K, 12M, 12C and 12Y, and the ink tanks 14K, 14M, 14C and 14Y are connected to the print heads 12K, 12M, 12C, and 12Y by means of prescribed channels 30. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the recording medium paper supply unit 22; however, more magazines 32 with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (media) can be used, it is preferable that an information recording medium such as a bar code and a wireless tag containing information about the type of medium is attached to the magazine, and by reading the information contained in the information recording medium with a predetermined reading device, the type of media to be used is automatically determined, and ink-droplet ejection is controlled so that the ink-droplets are ejected in an appropriate manner in accordance with the type of medium.

The recording medium 20 delivered from the recording medium supply unit 22 retains curl due to having been loaded in the magazine 32. In order to remove the curl, heat is applied to the recording paper 20 in the decurling unit 24 by a heating drum 34 in the direction opposite from the curl direction in the magazine 32. The heating temperature at this time is preferably controlled so that the recording medium 20 has a curl in which the surface on which the print is to be made is slightly round outward.

In the case of the configuration in which rolled paper is used, a cutter 38 is provided, and the rolled paper is cut into a desired size by the cutter 38. The cutter 38 has a stationary blade 38A, whose length is not less than the width of the conveyor pathway of the recording medium 20, and a round blade 38B, which moves along the stationary blade 38A. The stationary blade 38A is disposed on the reverse side of the printed surface of the recording medium 20, and the round blade 38B is disposed on the printed surface side across the conveyor pathway. When cut papers are used, the cutter 38 is not required.

After decurling in the decurling unit 24, the cut recording medium 20 is delivered to the conveyance unit 26. The conveyance unit 26 has a configuration in which an endless conveyance belt (electrostatic attraction belt) 43 is set around drive rollers 41 and 42 in such a manner that at least the portion of the endless belt 43 facing the nozzle faces of the respective print heads 12K, 12M, 12C and 12Y forms a flat plane.

The conveyance belt 43 is constituted by a conducting member, and is connected electrically to a DC power supply (not shown). When a DC voltage is applied by the DC power source, an electric field is applied to the conveyance belt 43, and the recording medium 20 is attracted to and held on the conveyance belt 43, by an electrostatic force of attraction.

The conveyance belt 43 is driven in the counter-clockwise direction in FIG. 1 by the motive force of a motor (not shown in FIG. 1, but indicated by reference numeral 109 in FIG. 6) being transmitted to at least one of the drive rollers 41 and 42, which the conveyance belt 43 is set around, and the recording medium 20 held on the conveyance belt 43 is conveyed from right to left in FIG. 1.

The print heads 12K, 12M, 12C and 12Y are full line heads having a length corresponding to the maximum width of the recording medium 20 used with the inkjet recording apparatus 10, and comprising a plurality of nozzles for ejecting ink arranged on a nozzle face through a length exceeding at least one edge of the maximum-size recording medium 20 (namely, the full width of the printable range).

The print heads 12K, 12C, 12M, and 12Y are arranged in color order (black (K), magenta (M), cyan (C), yellow (Y)) from the upstream side in the delivery direction of the recording medium 20, and each of the print heads 12K, 12M, 12C and 12Y is fixed extending in a direction (the main scanning direction) which is substantially perpendicular to the conveyance direction of the recording medium 20 (the sub-scanning direction).

A color image can be formed on the recording medium 20 by ejecting inks of different colors from the print heads 12K, 12C, 12M and 12Y, respectively, onto the media 20 while the recording medium 20 is conveyed by the conveyance unit 26.

By adopting a configuration in which full line type print heads 12K, 12M, 12C and 12Y having nozzles rows covering the full paper width are provided for each separate color in this way, it is possible to record an image on the full surface of the recording medium 20 by performing just one operation of moving the recording medium 20 relatively with respect to the print heads 12K, 12M, 12C and 12Y in the conveyance direction of the recording medium 20 (the sub-scanning direction), (in other words, by means of one sub-scanning action). A single pass image forming apparatus of this kind is able to print at high speed in comparison with a shuttle scanning system in which an image is printed by moving a print head back and forth reciprocally in the main scanning direction, and hence print productivity can be improved.

Although a configuration with four standard colors, K, M, C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added Moreover, there is no limitation on the arrangement order of the print heads of respective colors.

The post-drying unit 19 disposed on the downstream side of the print head 12Y (after the print head 12Y) has a heater (not shown in FIG. 1 and indicated by reference numeral 111 in FIG. 6) of a length corresponding to the maximum width of the recording medium 20, similarly to the print heads 12K, 12M, 12C and 12Y, and the heater is fixed extending in a direction substantially perpendicular to the conveyance direction of the recording medium 20. The post-drying unit 19 functions as a device which promotes the drying of the image surface formed on the recording medium 20, without making contact with the recording medium 20. A mode is also possible in which a porous roller which directly absorbs liquid from the recording medium 20 is provided above the conveyance path, and liquid on the recording medium 20 is removed by means of this porous roller.

The heater in the post-drying unit 19 is constituted by an infrared heater, for example, which causes the liquid on the recording medium 20 to evaporate. Here, the liquid removed from the surface of the recording medium 20 by evaporation is chiefly a solvent which has been separated from the coloring material of the ink on the recording medium 20, by the action of a treatment liquid. If the treatment liquid is remaining on the recording medium, then the treatment liquid is also caused to evaporate from the recording medium. Thereby, the ink on the recording medium is dried.

The recording medium 20 (the created printed matter) that has passed the post-drying unit 19 is output from the paper output unit 28 via nip rollers 47. Although not shown in FIG. 1, the paper output unit 28 is provided with a sorter for collecting images according to print orders.

In the inkjet recording apparatus 10 according to the present embodiment, treatment liquid droplet ejection heads 16 and 18 are provided respectively, one each, on the upstream side of the print head 12K (before the print head 12K) in terms of the paper conveyance direction and on the downstream side of the print head 12Y (after the print head 12Y) in terms of the paper conveyance direction, as devices for insolubilizing the ink on the recording medium 20.

The treatment liquid droplet ejection heads 16 and 18 are connected via channels (not shown), to a treatment liquid tank (not shown) which stores treatment liquid for supply to the treatment liquid droplet ejection heads 16 and 18.

By means of an inkjet recording apparatus 10 having a composition of this kind, droplets of treatment liquid are ejected onto the recording medium 20 before and after ejection of droplets of ink of the colors, Y, C, M and K. The ejection of the ink and the treatment liquid is described below.

Next, the structure of the print heads and the treatment liquid droplet ejection heads is described below. The print heads 12K, 12M, 12C and 12Y provided for the respective ink colors and the treatment liquid droplet ejection heads 16 and 18 have the same structure, and a reference numeral 50 is hereinafter designated to a representative example of these print heads.

Figure 2A:
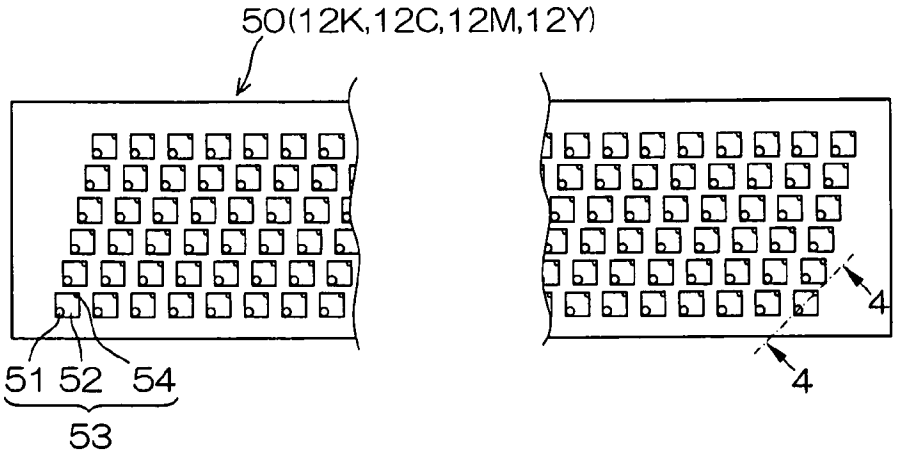
FIGS. 2A and 2B are a plan view perspective diagram showing an example of the structure of a print head, and a partial enlarged view of same.
Figure 2B:
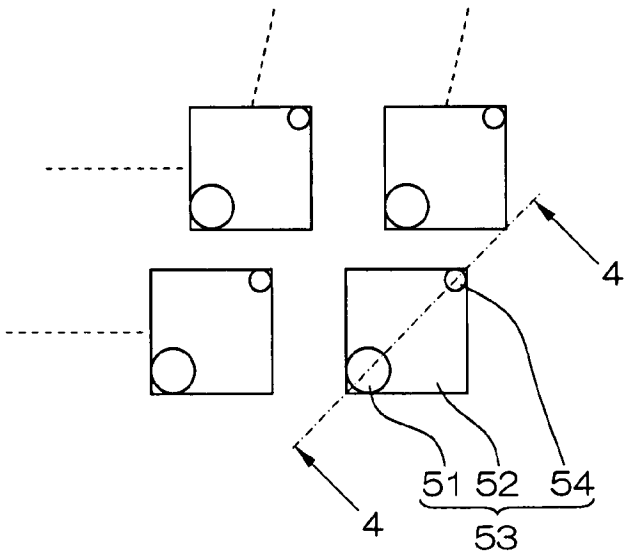

FIG. 2A is a plan view perspective diagram showing an example of the composition of a print head 50, and FIG. 2B is an enlarged diagram of a portion of same. Furthermore, FIG. 3 is a plan view perspective diagram showing a further example of the composition of a print head 50, and FIG. 4 is a cross-sectional diagram showing a three-dimensional composition of one liquid droplet ejection element (one ink chamber unit corresponding to one nozzle 51) (being a cross-sectional view along line 4-4 in FIGS. 2A and 2B).

The nozzle pitch in the print head 50 is required to be minimized in order to maximize the density of the dots printed on the surface of the recording medium 20. As shown in FIGS. 2 to 4, the print head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the print head (the direction substantially perpendicular to the paper conveyance direction) is reduced and high nozzle density is achieved.

Figure 3:
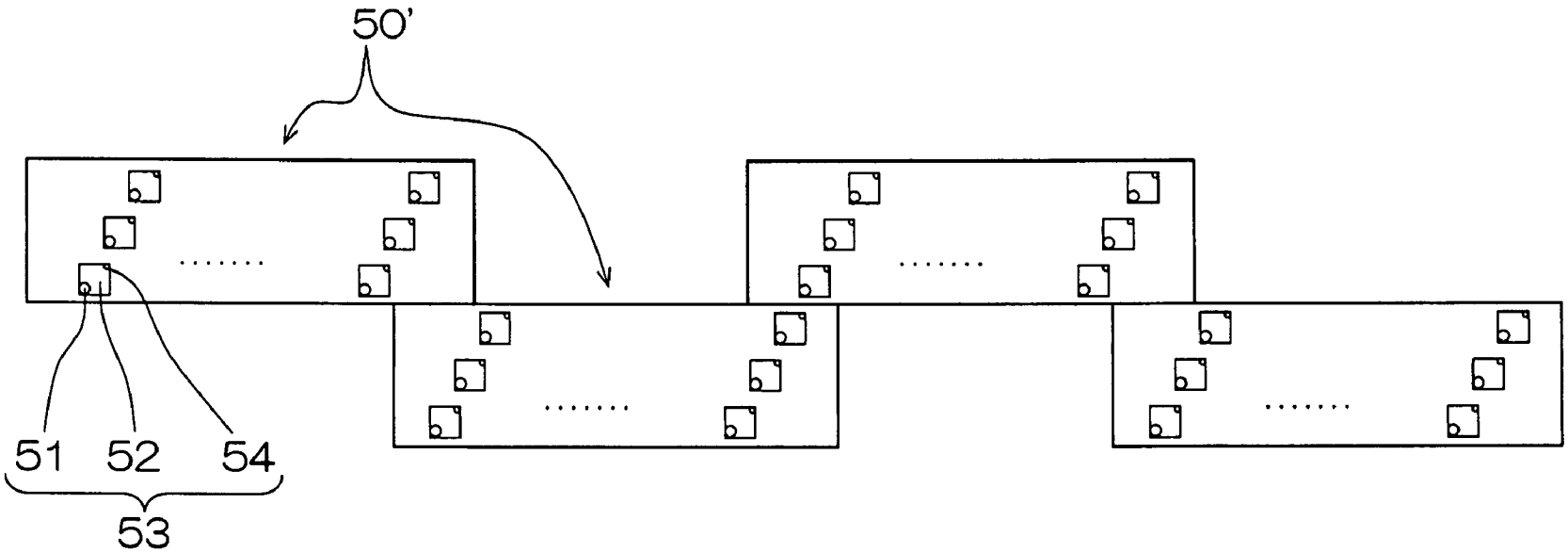
FIG. 3 is a plan view perspective diagram showing a further example of the structure of a print head.
Figure 4:
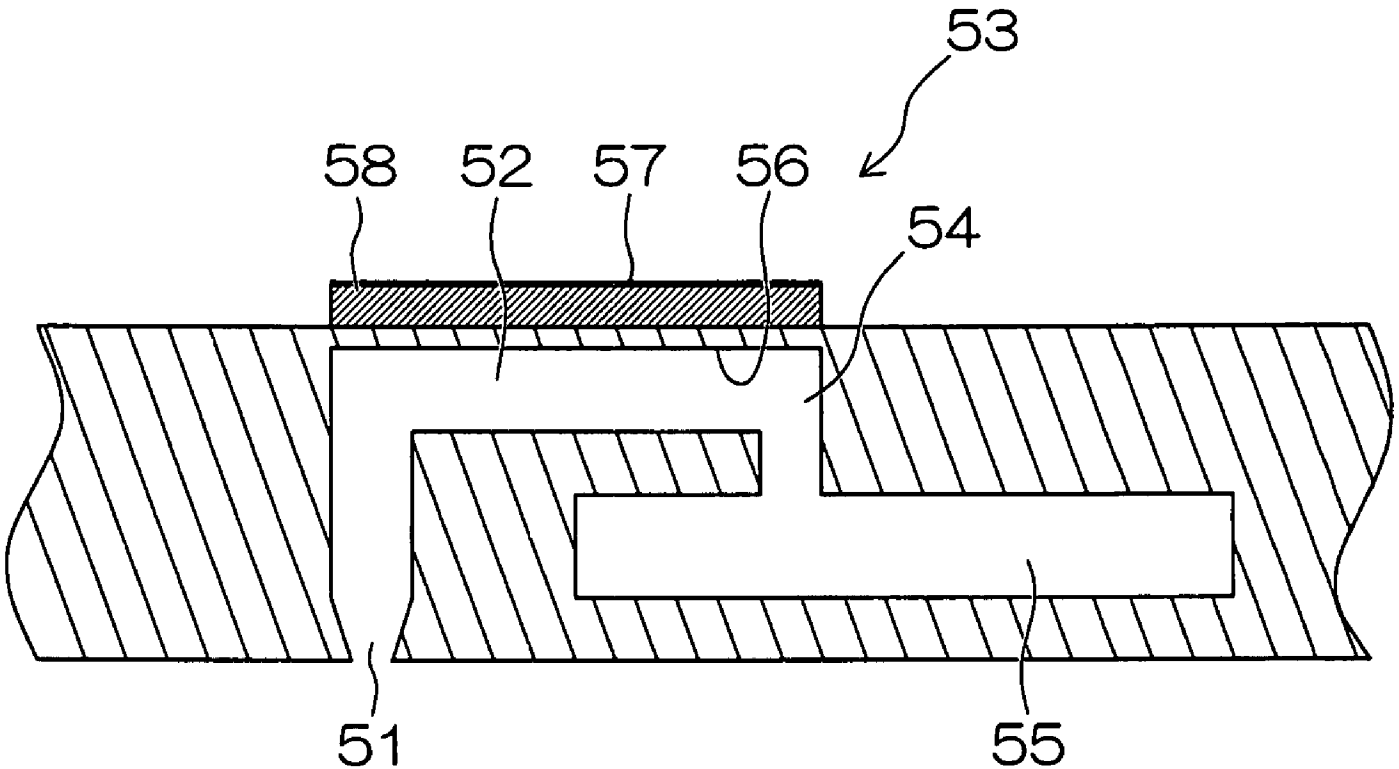
FIG. 4 is a cross-sectional diagram along line 4-4 in FIGS. 2A and 2B.

Furthermore, instead of the composition in FIGS. 2A and 2B, as shown in FIG. 3, a full line head having nozzle rows of a length corresponding to the entire width of the recording medium 20 can be formed by arranging and combining, in a staggered matrix, short head units 50' each having a plurality of nozzles 51 arrayed in a two-dimensional fashion.

The planar shape of the pressure chamber 52 provided for each nozzle 51 is substantially a square (see FIGS. 2A and 2B), and the nozzle 51 and an inlet of supplied ink (supply port) 54 are disposed in both corners on a diagonal line of the square.

As shown in FIG. 4, pressure chamber 52 is connected to a common channel 55 through the supply port 54. The common channel 55 is connected to an ink storing and loading section (not shown in FIG. 4, but shown as a unit 14 in FIG. 1), which is a base tank that supplies ink, and the ink supplied from the ink tanks 14K, 14M, 14C and 14Y is delivered through the common flow channel 55 in FIG. 4 to the pressure chambers 52.

An actuator 58 provided with an individual electrode 57 is joined to a pressure plate (common electrode) 56 which forms the upper face of each pressure chamber 52, and the actuator 58 is deformed when a drive voltage is supplied to the individual electrode 57 and the common electrode 56 to change the volume of the pressure chamber 52 and the pressure in accordance therewith, thereby causing ink to be ejected from the nozzle 51. A piezoelectric body, such as a piezo element, is suitable as the actuator 58. When ink is ejected, new ink is supplied to the pressure chamber 52 from the common flow channel 55 through the supply port 54.

Figure 5:
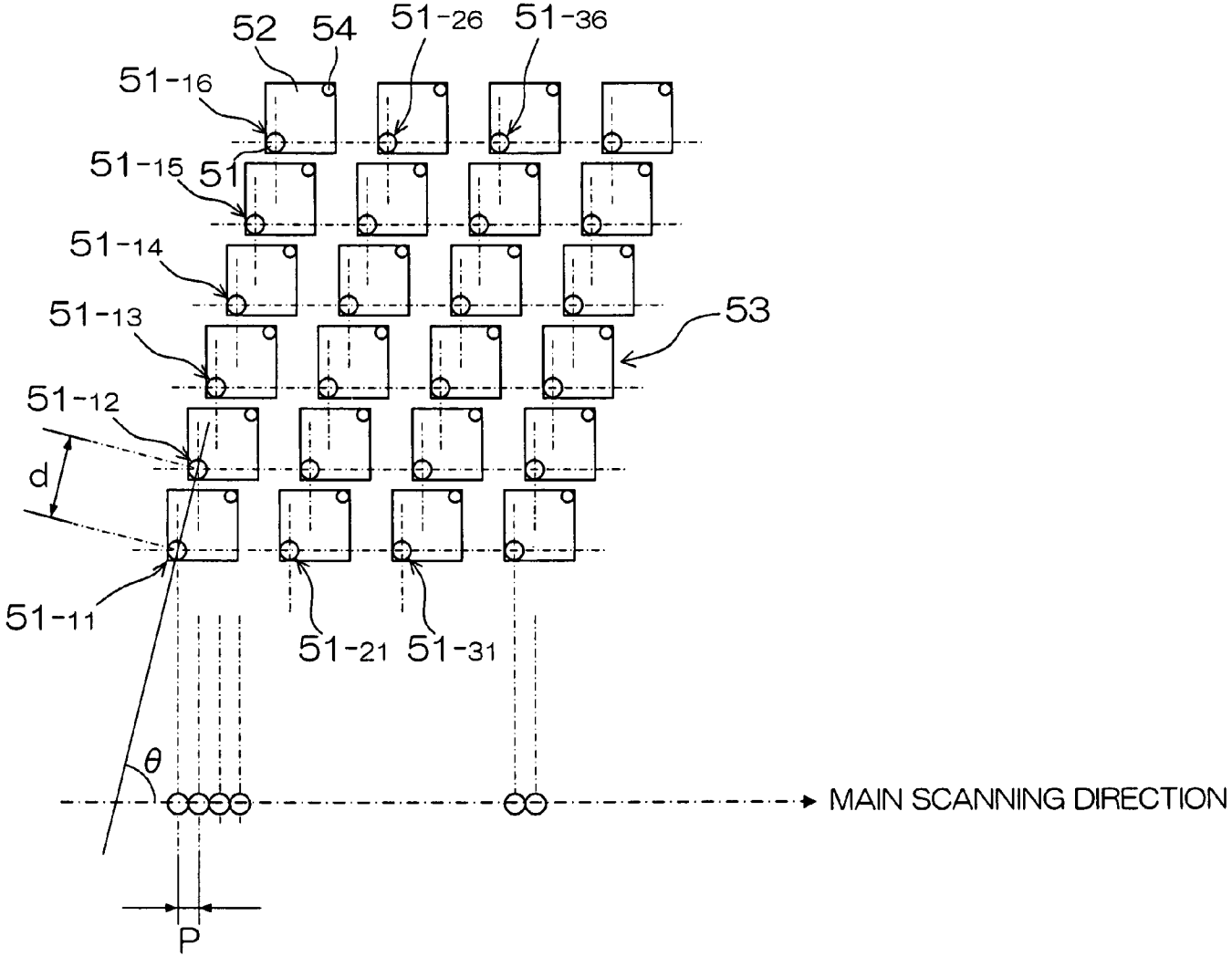
FIG. 5 is an enlarged view showing an example of the nozzle arrangement in the print head shown in FIGS. 2A and 2B.

As shown in FIG. 5, a plurality of ink chamber units 53 having the above-described structure are arranged in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is d×cos θ, and hence the nozzles 51 can be regarded to be equivalent to those arranged linearly at a fixed pitch P along the main scanning direction. Such configuration results in a nozzle structure in which the nozzle row projected in the main scanning direction has a high nozzle density.

In a full-line head comprising rows of nozzles that have a length corresponding to the entire width of the image recordable width, the "main scanning" is defined as printing one line or one strip in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording medium 20 by sequentially driving the nozzles 51-11, 51-12, . . . 51-16 in accordance with the conveyance velocity of the recording medium 20.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The print head 50 having the composition described above has the same structure as the treatment liquid droplet ejection heads 16 and 18. In other words, each of the treatment liquid droplet ejection heads 16 and 18 also comprises a plurality of treatment liquid chamber units including pressure chambers corresponding to nozzles, and has a structure in which these treatment liquid chamber units are arranged (two-dimensionally) in a staggered matrix configuration. Treatment liquid is supplied to the treatment liquid chamber units from the treatment liquid tank, via a common flow channel.

According to the present invention, the arrangement of the nozzles is not limited to that of the example shown. Moreover, in the present embodiment, a method is employed in which a droplet or ink or treatment liquid is ejected by means of the deformation of the actuator, which is, typically, a piezoelectric element, but in implementing the present invention, the method used for ejecting ink and treatment liquid is not limited in particular, and instead of a piezo jet method, it is also possible to apply various other types of methods, such as a thermal jet method, wherein the ink and treatment liquid is heated and bubbles are caused to form therein, by means of a heat generating body, such as a heater, droplets or ink or treatment liquid being ejected by means of the pressure of these bubbles.

Figure 6:
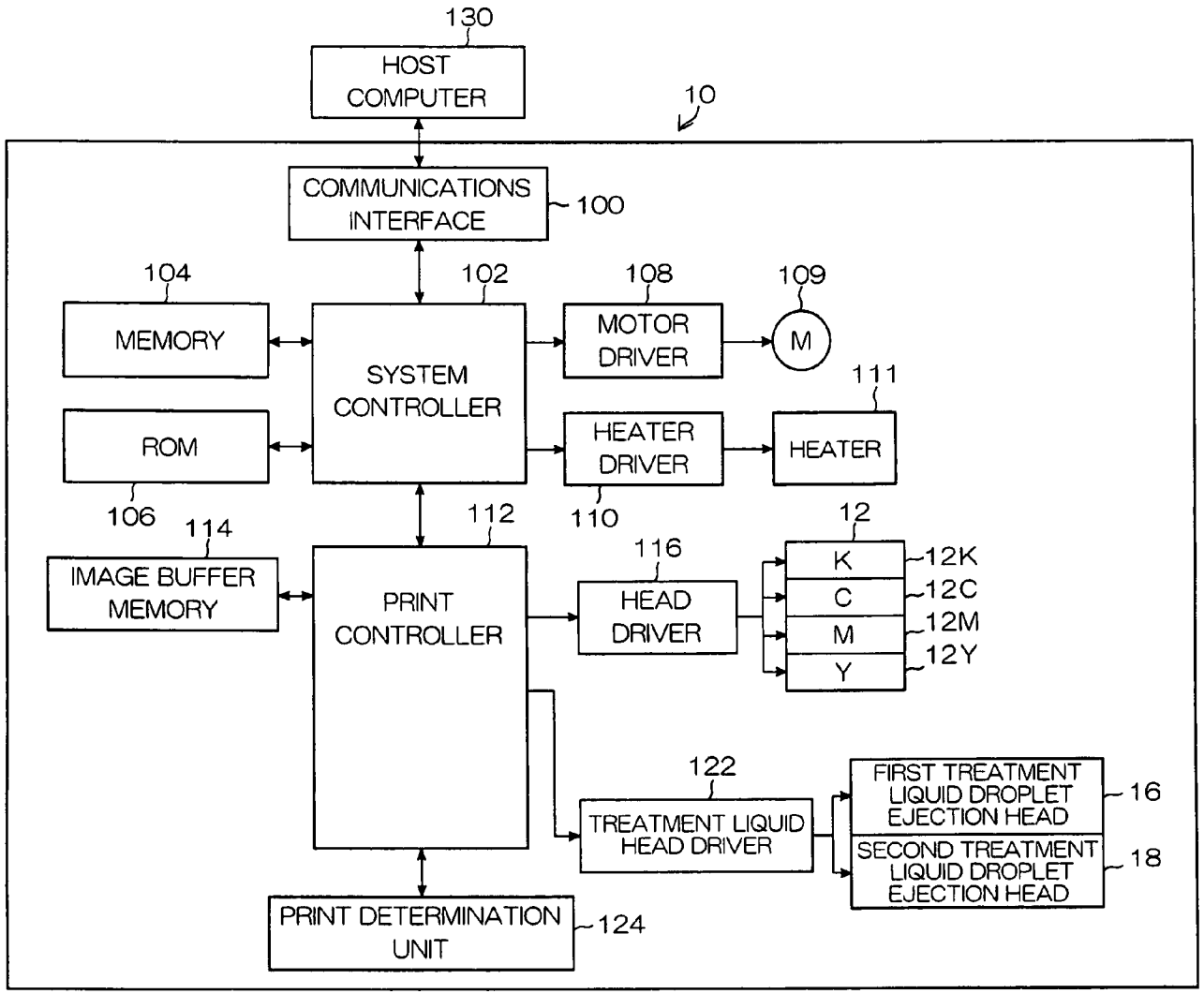
FIG. 6 is a principal block diagram showing the system composition of the inkjet recording apparatus.

FIG. 6 is a principal block diagram showing the system composition of the inkjet recording apparatus 10.

The inkjet recording apparatus 10 shown in FIG. 6 comprises a communications interface 100, a system controller 102, a memory 104, a ROM 106, a motor driver 108, a heater driver 110, a print controller 112, an image buffer memory 114, a head driver 116, a print head 12, a treatment liquid head driver 122, treatment liquid droplet ejection heads 16 and 18, a print determination unit 124, and the like.

The communications interface 100 is an interface unit for receiving image data transmitted by a host computer 130. For the communications interface 100, it is possible to use a wired communications interface, such as USB (Universal Serial Bus), IEEE 1394, Ethernet (registered trademark) or the like, or a serial interface, such as a wireless network, or a parallel interface, such as a Centronics interface. It is also possible to install a buffer memory (not shown) in this part for achieving high-speed communications. In the present embodiment, there are no particular limitations on the image data input mode, provided that image data is input by means of communications with the host computer 130. For example, it is also possible to input image data by reading in image data from a removable media, such as a memory card or optical disk.

Image data sent from a host computer 130 is read into the inkjet recording apparatus 10 via the communications interface 100, and is stored temporarily in the memory 104. The memory 104 is a storage device for temporarily storing an image input via the communications interface 100, and data is written to and read from the image memory 104 via the system controller 102. In addition, the memory 104 also stores a program for image formation processing, and information of various kinds required to execute the program, and the like.

The system controller 102 is a control unit for controlling the various sections, such as the communications interface 100, the memory 104, the motor driver 108, the heater driver 110, and the like. The system controller 102 is constituted by a central processing unit (CPU) and peripheral circuits thereof, and the like, and in addition to controlling communications with the host computer 130 and controlling reading and writing from and to the memory 104, and the like, the system controller 102 also generates a control signal for controlling the motor 109 of the conveyance system and the heater 111.

The motor driver 108 is a driver (drive circuit) which drives the motor 109 in accordance with instructions from the system controller 102. More specifically, it suctions the recording medium onto the conveyance belt which constitutes the conveyance unit (reference numeral 26 in FIG. 1) and drives the conveyance belt, and the like.

The heater driver 110 is a driver for driving the heater 111 of the post-drying unit 19 and the heating drum 34, in accordance with instructions from the system controller 102 (see FIG. 1).

The print controller 112 is a control unit having a signal processing function for performing various treatment processes, corrections, and the like, in accordance with the control implemented by the system controller 102, in order to generate a signal for controlling printing on the basis of the image data in the memory 104, and it supplies the print control signal (dot data) thus generated to the head driver 116 and the treatment liquid head driver 122. Prescribed signal processing is carried out in the print controller 112, and the ejection volume and the ejection timing of an ink droplet from each of the print heads 12K, 12M, 12C and 12Y of the colors are controlled via the head driver 116, on the basis of the image data. By this means, desired dot size and dot positions can be achieved. Furthermore, similarly, the ejection volume and ejection timing of the treatment liquid from the treatment liquid droplet ejection heads 16 and 18 are controlled by the print controller 112, via the treatment liquid head driver 122.

The image buffer memory 114 is provided in the print controller 112, and image data, parameters, and other data are temporarily stored in the image buffer memory 114 when image data is processed in the print controller 112. Here, a mode is shown in which the image buffer memory 114 is attached to the print controller 112; however, the memory 104 may also serve as the image buffer memory 114. Also possible is a mode in which the print controller 112 and the system controller 102 are integrated to form a single processor.

The head driver 116 drives the actuators (not shown) which drive ejection in the print heads 12K, 12M, 12C and 12Y, on the basis of the dot data supplied from the print controller 112. A feedback control system for maintaining constant drive conditions for the print heads may be included in the head driver 116.

Similarly to the head driver 116, the treatment liquid head driver 122 drives the ejection driving actuators (not shown) of the treatment liquid droplet ejection heads 16 and 18 on the basis of dot data supplied by the print controller 112.

Here, desirable modes for controlling the volumes of the treatment liquid and ink deposited onto the recording medium from the nozzles of the treatment liquid droplet ejection heads 16 and 18 and the print head 12 include: a mode where the deposition volume is controlled by actually altering the nozzle diameter, for example; and a mode where the ejection volume is controlled by altering the drive waveform, without changing the nozzle diameter. In the present embodiment, the ejection volume is controlled by altering the drive waveform. In other words, drive signals including drive waveform is output to the print head 12 and the treatment liquid droplet ejection heads 16 and 18, by the head driver 116 and the treatment liquid head driver 122.

The image data to be printed is externally inputted through the communications interface 100, and is stored temporarily in the memory 104. At this stage, RGB image data is stored in the memory 104, for example. The image data stored in the image memory 104 is sent to the print controller 112 through the system controller 102, and is converted into dot data for each ink color by a known dithering algorithm, error diffusion method or another technique in the print controller 112. The image memory 104 is not limited to a memory constituted by a semiconductor element; and a magnetic medium, such as a hard disk, or the like, may also be used for the image memory 104.

The print heads 12K, 12M, 12C and 12Y are driven on the basis of the dot data thus generated by the print controller 112 so that ink is ejected from the print heads 12K, 12M, 12C and 12Y. By controlling ink ejection from the print heads 12K, 12M, 12C and 12Y in synchronization with the conveyance speed of the recording medium 20, an image is formed on the recording medium 20. Furthermore, as described below, the treatment liquid droplet ejection heads 16 and 18 are controlled and driven on the basis of the dot data, and treatment liquid is ejected from the treatment liquid droplet ejection heads 16 and 18. The ink on the recording medium 20 is insolubilized by this treatment liquid.

In the present embodiment, the system controller 102, motor driver 108, heater driver 110, head driver 116, and treatment liquid head driver 122, are constituted wholly or partially by means of a microprocessor.

Next, the treatment liquid droplet ejection head and the treatment liquid are described below.

As shown in FIG. 1, a treatment liquid droplet ejection head 16 is disposed on the upstream side of the print head 12K (before the print head 12K) in terms of the recording medium conveyance direction (the direction of the arrow in FIG. 1), and a treatment liquid droplet ejection head 18 is disposed on the downstream side of the print head 12Y (after the print head 12Y) in terms of the recording medium conveyance direction. The system of these treatment liquid droplet ejection heads 16 and 18 are similar to that of the print heads 12K, 12M, 12C and 12Y (see FIGS. 2A and 2B to FIG. 5), as stated above, and treatment liquid is ejected from the nozzles of the treatment liquid droplet ejection heads 16 and 18 onto the recording medium 20.

Accordingly, the recording medium 20 is conveyed on the conveyance belt 43 driven by the drive rollers 41 and 42, successively, to a droplet ejection position by the first treatment liquid droplet ejection head 16, a droplet ejection position by the first print head 12K, a droplet ejection position by a second print head 12M, a droplet ejection position by a third print head 12C, a droplet ejection position by a fourth print head 12Y, and a droplet ejection position by the second treatment liquid droplet ejection head 18. Droplets of the inks and treatment liquid are ejected according to requirements. Thereupon, the recording medium 20 is conveyed to the post-drying unit 19.

The print heads 12K, 12M, 12C and 12Y, and the corresponding treatment liquid droplet ejection heads 16 and 18 are equivalent to the "liquid deposition device" or "liquid droplet ejection device" in the above summary of the invention. Embodiments of the present invention is not limited to a composition which is divided into print heads and treatment liquid heads as in the present embodiment, and it is also possible to adopt a composition in which these heads are integrated together.

On the other hand, the treatment liquid is a liquid which, when mixed with the ink, produces a two-liquid reaction whereby an aggregate of the coloring material is generated, and furthermore, this aggregate of the coloring material is charged with either a positive or negative charge.

As a device for generating an aggregate of the coloring material of this kind, there are methods such as reacting an anionic coloring material with a cationic compound, producing dispersive breakdown of a pigment-based ink by changing the pH, producing dispersive breakdown of a pigment-based ink by reaction with a multivalent metallic salt, or the like. As a means for applying a charge to the aggregate of the coloring material, there are methods such as adjusting the composition of the ink or treatment liquid in such a manner that an anionic or cationic group remains on the surface of the aggregate of the coloring material during the anionic/cationic reaction, or controlling the surface potential of a pigment by adjusting pH, or the like.

Before describing the step of separating the ink solvent and the coloring material, the deposition of the treatment liquid onto the recording medium is described below.

Figure 7:
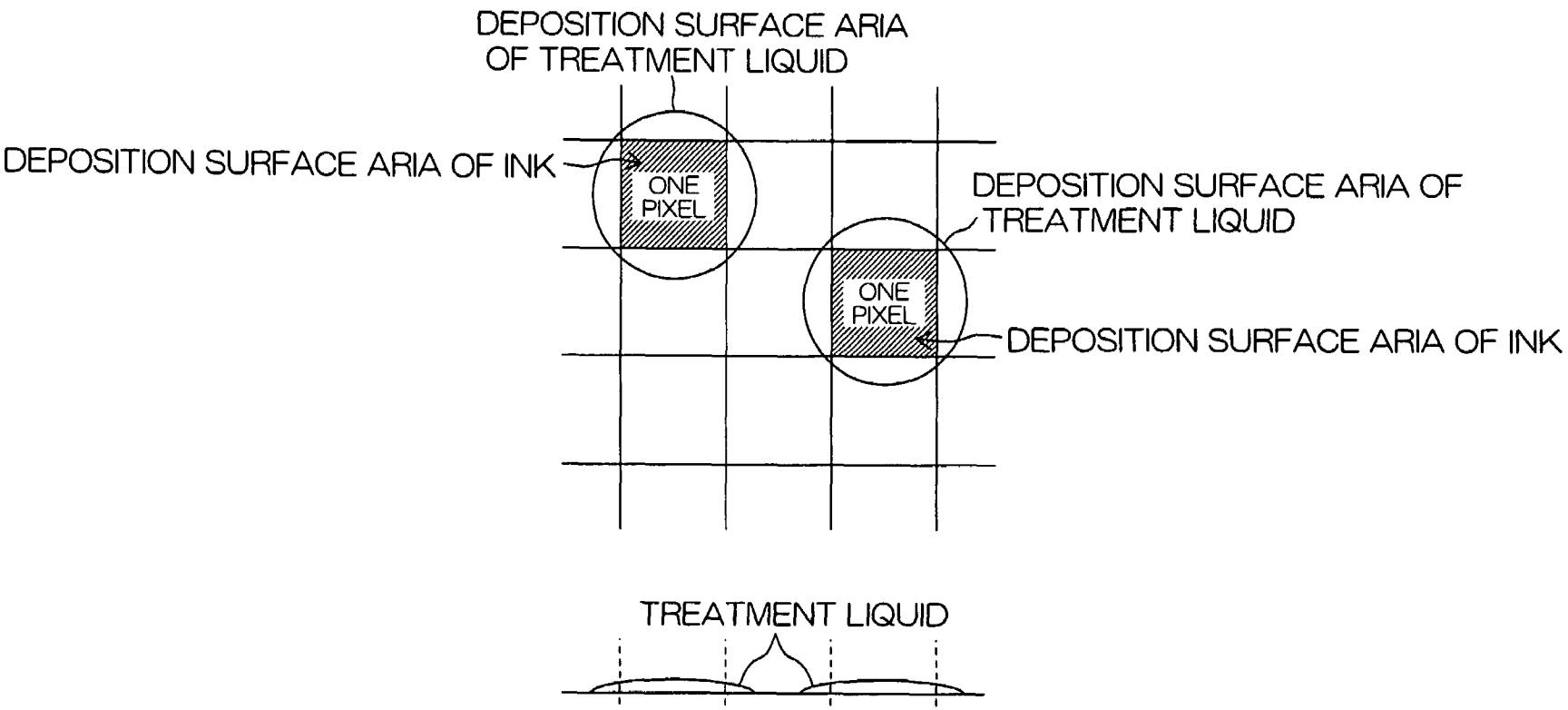
FIG. 7 is an illustrative diagram showing the spreading of treatment liquid on a recording medium.
Figure 8A:
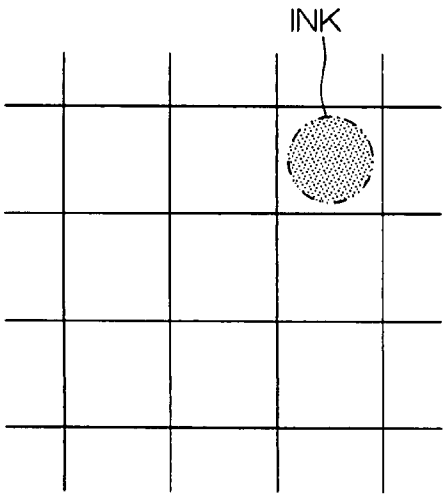
FIGS. 8A and 8B are diagrams showing the relationship between the deposition surface areas of the ink and treatment liquid deposited on a recording medium.
Figure 8B:
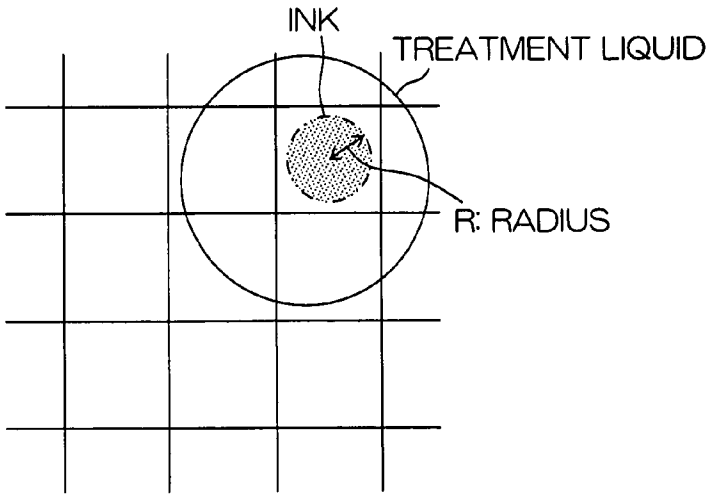

Considering a case where the treatment liquid forming the first liquid ejected by the treatment liquid droplet ejection head 16 is deposited in a thinned-out fashion as shown in FIG. 7, it is possible to reduce the apparent deposition volume of the treatment liquid of the first liquid. However, regarding the pixels apart from the pixels where treatment liquid have been deposited, it is difficult to cover the whole area of each of the pixels with the treatment liquid. Consequently, there is a difference in the volume of treatment liquid deposited, depending on the pixels. Therefore, if ink is deposited onto the pixels which are not covered completely with the treatment liquid, the reaction does not occur in a portion of the ink. Therefore, supposing that the deposition surface area of the ink corresponds to a circle of radius R, as shown in FIGS. 8A and 8B, the treatment liquid is deposited on the recording medium on a deposition surface area that is equal to or greater than the surface area specified by the radius R. In other words, the deposition surface area on the recording medium of the treatment liquid of the first liquid, immediately before deposition of the ink, is a region that is greater than the deposition surface area onto which the ink is deposited. This control is carried out by the print controller 112 shown in FIG. 6, and drive signals including the drive waveform are output to the treatment liquid droplet ejection heads 16 and 18 via the treatment liquid head driver 122.

The deposition surface area per pixel is the surface area over which the liquid spreads on the recording medium, due to the deposition of liquid per pixel of the recording medium as indicated by the oblique shaded section in FIG. 7. The deposition volume per pixel is the volume of liquid deposited per pixel on the recording medium, as indicated by the oblique shaded section in FIG. 7.

In implementing embodiments of the present invention, a treatment liquid having the low surface tension is used, in such a manner that the treatment liquid spreads to a broad deposition surface area on the recording medium 20.

Furthermore, in the present embodiment, the treatment liquid is deposited as a first liquid from the treatment liquid droplet ejection head 16, and as a third liquid from the treatment liquid droplet ejection head 18, onto the recording medium 20. It is possible to use a treatment liquid of the same composition, in other words, a liquid having the same surface tension, for the treatment liquid of the first liquid and the treatment liquid of the third liquid; however, the embodiments of the present invention are not limited to this, and it is also possible to use different liquids having different compositions and different surface tensions, for the treatment liquid of the first liquid and the treatment liquid of the third liquid. In this case, if the surface tensions of the treatment liquids of the first liquid and the third liquid are taken to be $\gamma 1$ and $\gamma 3$ respectively, and if the surface tension of the ink forming the second liquid is taken to be $\gamma 2$, then the liquids satisfying the following relationships are used:

$$\gamma 1 < \gamma 2 \quad \text{Formula (1)}$$

$$\gamma 3 < \gamma 2 \quad \text{Formula (2)}$$

To give a concrete description, if the surface tension of the treatment liquid of the first liquid is greater than the surface tension of the ink of the second liquid, then the ink of the second liquid having lower surface tension extends over the perimeter of the treatment liquid of the first liquid having greater surface tension, and the outermost surface is constituted by the ink. Therefore, ink which does not react with the treatment liquid projects in all horizontal direction beyond the perimeter of the treatment liquid of the first liquid, and this causes feathering. Consequently, the surface tension of the treatment liquid of the first liquid is made to be smaller than the surface tension of the ink of the second liquid.

Furthermore, if the surface tension of the treatment liquid of the third liquid is greater than the surface tension of the ink of the second liquid, then the treatment liquid of the third liquid having greater surface tension is concentrated at one position on the surface of the ink of the second liquid having lower surface tension, and hence the ink in the outermost surface does not react satisfactorily with the treatment liquid. Therefore, the surface tension of the treatment liquid of the third liquid is made to be smaller than the surface tension of the ink of the second liquid, and the treatment liquid of the third liquid is deposited in a superimposed fashion in such a manner that the third liquid encompasses the ink of the second liquid.

The treatment liquid of the first liquid deposited onto the recording medium is not limited to one droplet ejection (one dot), and it may be composed by depositing a plurality of dots over a region that is greater than the ink deposition surface area. In conjunction with this, it is also possible to adopt a composition in which the treatment liquid of the third liquid is deposited onto the recording medium so as to form a plurality of dots.

Concrete Example of Insolubilization

The step of insolubilizing the ink by means of the inkjet recording apparatus 10 having the composition described above, in other words, the step of separating the ink solvent and coloring material on the recording medium 20, are described below with reference to FIG. 9A to FIG. 10F. FIGS. 9A to 10F are schematic drawings showing one example of a situation where treatment liquid and ink are deposited onto a recording medium 20, and they depict the state of the ink and treatment liquid ejected in the form of droplets from one nozzle of a particular print head on the recording medium 20 (21).

Firstly, a case where a non-permeable medium, into which the ink and treatment liquid do not permeate, is used as the recording medium 20, is described with reference to FIGS. 9A to 9F.

Figure 9A:
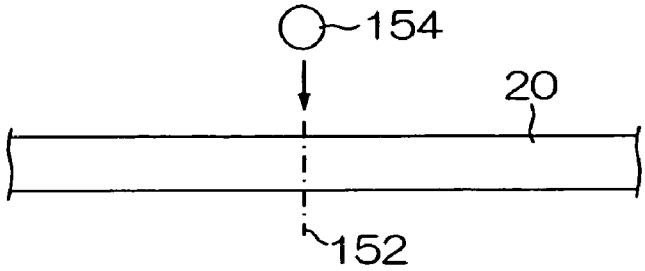
FIGS. 9A to 9F are schematic drawings showing one example of a mode in which the treatment liquid and ink are deposited onto a recording medium.

Firstly, as shown in FIG. 9A, a droplet of treatment liquid is ejected previously from the treatment liquid droplet ejection head 16 toward a droplet ejection position (taken to be the position 152 under consideration) on the recording medium 20 for each of the print heads, before ejecting droplets of ink from the print heads (12K, 12M, 12C and 12Y). More specifically, when the position 152 under consideration has reached the position (the first liquid treatment liquid droplet ejection position) on the conveyance path where a droplet of treatment liquid is ejected from the treatment liquid droplet ejection head 16, then a droplet of treatment liquid (liquid droplet) 154 is ejected from the treatment liquid droplet ejection head 16 toward the recording medium 20. In this case, the ejected volume of treatment liquid is set to be smaller than the volume of ink ejected subsequently by the print head (reference numeral 156 in FIG. 9C).

In other words, if the deposition volume per pixel of the treatment liquid of the first liquid is taken to be V1_Pixel, and the deposition volume per pixel of the ink of the second liquid is taken to be V2_Pixel, then the following relationship is established:

$$V1_Pixel < V2_Pixel \quad \text{Formula (3)}$$

Accordingly, the ink can react in the vicinity of the surface of the recording medium 20.

Figure 9B:
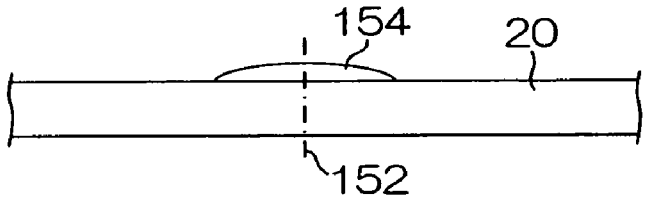

As shown in FIG. 9B, when treatment liquid 154 is deposited on the position 152 under consideration of the recording medium 20, the treatment liquid 154 spreads over the surface of the recording medium 20. For the treatment liquid 154, a liquid having a low surface tension is used, as stated above, and therefore, even if a small volume of the treatment liquid of the first liquid is deposited, as mentioned previously, it is possible to achieve a large deposition surface area of the treatment liquid 154 on the surface of the recording medium 20, as shown in FIG. 9B.

Figure 9C:
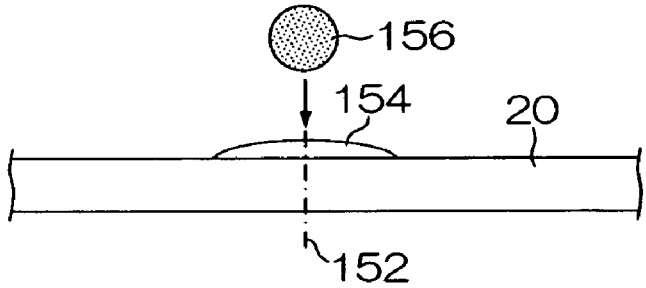

The treatment liquid 154 ejected as a droplet onto the recording medium 20 is conveyed directly below the print heads (12K, 12M, 12C and 12Y) in accordance with the conveyance of the recording medium 20 in the paper conveyance direction (the direction of the arrow in FIG. 1). Thereupon, as shown in FIG. 9C, when the position 152 under consideration of the recording medium 20 reaches a position on the conveyance path where a droplet of ink is to be ejected from the corresponding print head (namely, an ink droplet ejection position for the second liquid), then a droplet of ink (liquid droplet) 156 is ejected from the corresponding print head, onto the position 152 under consideration of the recording medium 20.

Figure 9D:
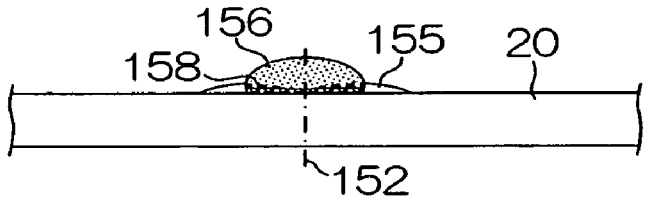

Since the ink droplet 156 ejected by the corresponding print head 12 has a greater surface tension than the treatment liquid 154, as indicated in Formula (1), then it lands in a superimposed fashion, directly on top of the treatment liquid 154 on the recording medium 20. The treatment liquid 154 ejected previously onto the position 152 under consideration on the recording medium 20, and the ink 156 ejected newly onto the recording medium 20 react together, and a mixed liquid which combines the two liquids, namely a portion of the treatment liquid 154, and the ink 156, is formed on the recording medium 20. Thereupon, as shown in FIG. 9D, it forms a coloring material layer 158 which is generated by downward sinking of the coloring material aggregate in the mixed liquid, and a solvent 155 which is separated in the mixed liquid.

Figure 9E:
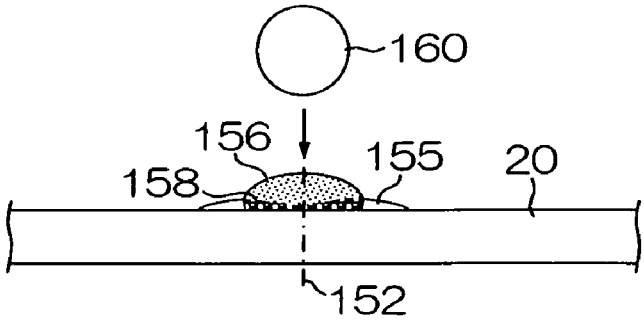

Next, as shown in FIG. 9E, when the position 152 under consideration of the recording medium 20 reaches a position on the conveyance path where a droplet of the treatment liquid is to be ejected from the treatment liquid droplet ejection head 18 (the treatment liquid droplet ejection position for the third liquid), then a droplet of the treatment liquid (liquid droplet) 160 is ejected from the treatment liquid droplet ejection head 18, onto the position 152 under consideration of the recording medium 20.

Here, the treatment liquid 160 ejected from the treatment liquid ejection head 18 has a greater volume than the treatment liquid 154 ejected by the treatment liquid droplet ejection head 16.

In other words, taking the deposition volume per pixel of the treatment liquid of the third liquid to be V3_Pixel, the following relationship is established:

$$V1_Pixel < V3_Pixel \qquad \text{Formula (4)}$$

Consequently, a sufficient volume of treatment liquid 160 is deposited after depositing the ink 156 onto the recording medium 20, and hence the ink 156 can rapidly be insolubilized, completely.

Furthermore, since the surface tension of the treatment liquid 160 ejected from the treatment liquid droplet ejection head 18 is smaller than that of the ink 156, as indicated by Formula (2), then the treatment liquid 160 lands in a superimposed fashion on the ink 156 on the recording medium 20 in such a manner that the treatment liquid 160 encompass the ink 156.

To give a concrete description of the reaction between the ink and the treatment liquid, the mixed liquid of the ink and treatment liquid changes to a mixed liquid containing a coloring material aggregate which is negatively charged by means of the two-liquid reaction. The coloring material aggregate in the mixed liquid sinks downward, and the mixed liquid is separated into a coloring material layer constituted by a coloring material aggregate and a solvent layer constituted by a solvent.

Figure 9F:
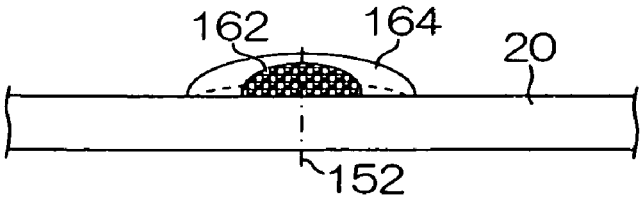

FIG. 9F shows a coloring material layer 162 and a solvent layer 164 obtained by means of this reaction.

Desirably, the total of the deposition volume per pixel of the treatment liquid of the first liquid and the deposition volume per pixel of the treatment liquid of the third liquid is greater than the deposition volume per pixel of the ink of the second liquid. In other words, provided that the following relationship is established, $$V1_Pixel + V3_Pixel > V2_Pixel \qquad \text{(Formula 5)}$$

then the treatment liquid 160 of a sufficient volume is deposited onto the ink 156 on the recording medium 20, and hence the reaction of the ink 156 is promoted further, which is desirable.

After passing through these steps, the recording medium 20 is conveyed to a position opposing the post-drying unit 19, and the recording medium 20 is dried by the post-drying unit 19 (see FIG. 1). Accordingly, the solvent in the solvent layer 164 evaporates, and the coloring material component becomes fixed on the surface of the recording medium 20.

Next, another mode, namely, a case where a permeable medium, into which ink and treatment liquid can permeate, is used as the recording medium 21, is described below with reference to FIGS. 10A to 10F.

Figure 10A:
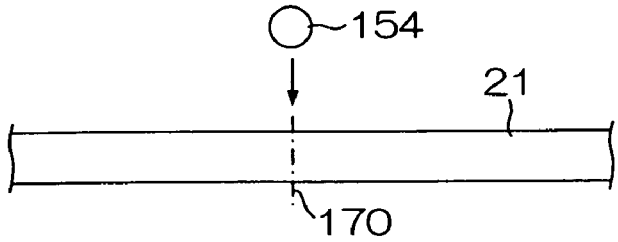
FIGS. 10A to 10F are schematic drawings showing a further example of a mode in which the treatment liquid and ink are deposited onto a recording medium.

Firstly, as shown in FIG. 10A, a droplet of treatment liquid (liquid droplet) 154 is ejected from the treatment liquid droplet ejection head 16 onto a position 170 under consideration on the recording medium 21. The volume of treatment liquid ejected as a droplet is set to be smaller than the volume of ink ejected as a droplet by the print head (reference numeral 156 in FIG. 10C), in such a manner that the relationship in Formula (3) is established.

Accordingly, the ink can react in the vicinity of the surface of the recording medium 21.

Figure 10B:
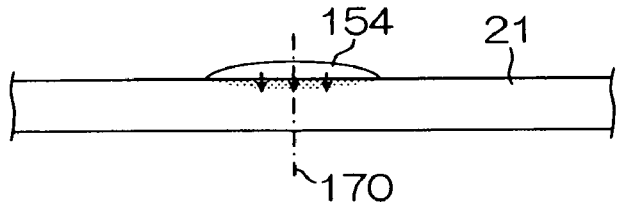

As shown in FIG. 10B, when the treatment liquid 154 is deposited on the position 170 under consideration of the recording medium 21, the treatment liquid 154 spreads over the surface of the recording medium 21. A liquid having low surface tension is used as the treatment liquid 154, and hence it is possible to obtain a large deposition surface area for the treatment liquid 154 on the surface of the recording medium 21. Accordingly, as stated previously, even if a small volume of the treatment liquid of the first liquid is deposited, there is no occurrence of locations where the treatment liquid is not present, within a pixel. Simultaneously with the deposition of the treatment liquid 154, the permeation of the treatment liquid 154 into the recording medium 21 starts.

Figure 10C:
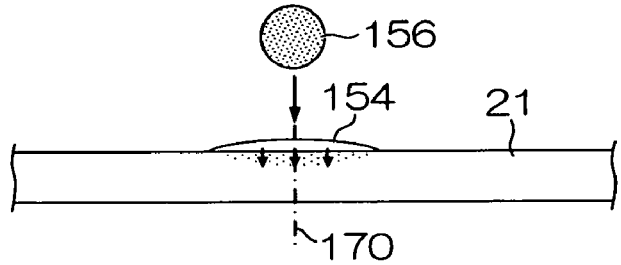

Next, as shown in FIG. 10C, a droplet of ink (liquid droplet) 156 is ejected from the corresponding print head onto the position 170 under consideration on the recording medium 21.

Figure 10D:
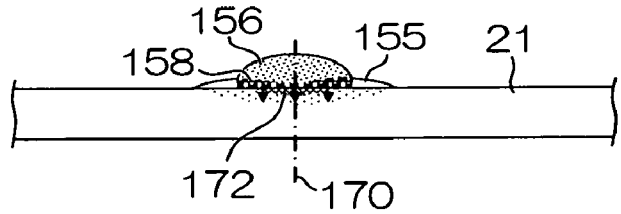

Since the ink 156 ejected from the print head 12 has higher surface tension than the treatment liquid 154 (see Formula (1)), then the ink 156 lands in a superimposed fashion, directly on top of the treatment liquid 154 on the recording medium 21, and the treatment liquid 154 and the ink 156 react together, thereby forming a mixed liquid combining a portion of the treatment liquid 154 and the ink 156 on the recording medium 21. Thereupon, as shown in FIG. 10D, it changes into a coloring material layer 158 generated by the coloring material aggregate sinking downward in the mixed liquid, and a solvent 155 which is separated in the mixed liquid.

Figure 10E:
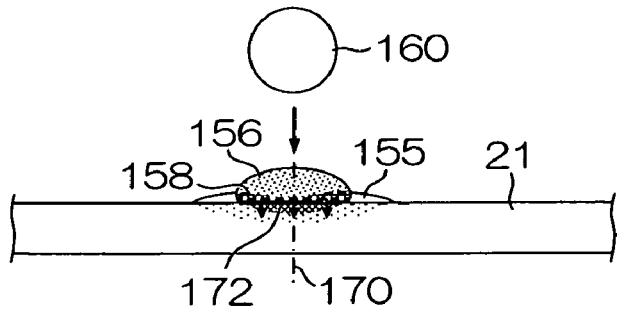

Subsequently, as shown in FIG. 10E, a droplet of treatment liquid (liquid droplet) 160 is ejected from the treatment liquid droplet ejection head 18 onto a position 170 under consideration on the recording medium 21.

Here, the treatment liquid 160 ejected from the treatment liquid ejection head 18 has a greater volume than the treatment liquid 154 ejected by the treatment liquid droplet ejection head 16 (see Formula (4)). Accordingly, it is possible rapidly to insolubilize the ink 156, completely.

Furthermore, since the surface tension of the treatment liquid 160 ejected from the treatment liquid droplet ejection head 18 is smaller than that of the ink 156, (see Formula (2)), then the treatment liquid 160 lands in a superimposed fashion on the ink 156 on the recording medium 20 in such a manner that the treatment liquid 160 encompasses the ink 156.

Figure 10F:
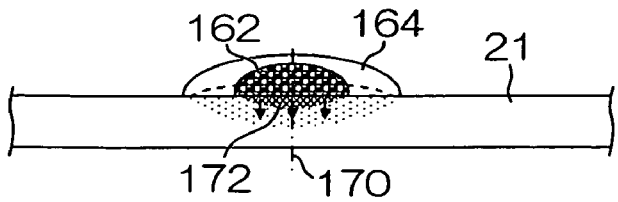

FIG. 10F shows a coloring material layer 162 and a solvent layer 164 obtained by means of this reaction.

Since the recording medium 21 is a permeable medium, then a portion of the coloring material component of the coloring material layer 162 (158) permeates inside the recording medium 21, together with the solvent component of the solvent layer 164 (reference numeral 172 in FIGS. 10D to 10F). Accordingly, the ink can be fixed securely on the recording medium 21.

Subsequently, the recording medium 21 is conveyed to the post-drying unit 19 (see FIG. 1), where drying is carried out, and coloring material component is fixed on the surface and in the interior of the recording medium 21.

It is also possible to achieve insolubilization of the ink, by increasing the concentration of the treatment liquid. However, this is not practicable since it takes time until the reaction completes, and blocking of the nozzles of a treatment liquid droplet ejection head is liable to occur due to increase in the viscosity which accompanies the increase in the concentration of the treatment liquid. Consequently, the mode described in the present embodiment in which a treatment liquid of weak concentration spreads over the recording medium can be regarded as the most desirable mode.

Furthermore, it is not practicable to use a small volume of treatment liquid, even if it has sufficient components to react completely with the ink, since the treatment liquid takes time to react with the ink. Consequently, provided that the treatment liquid has the same components, it is more desirable to adopt a mode in which a larger volume of a treatment liquid having lower concentration, rather than a highly concentrated treatment liquid, is used.

To describe a concrete classification of a permeable medium and a non-permeable medium, for example, a recording medium which has a permeation time of more than 100 ms when a 2 pl droplet of aqueous solution having a viscosity of 3 cP and a surface tension of 30 mN/m is deposited thereon, is classified as a "non-permeable" medium, and a medium having a permeation time of 100 ms or less is classified as a "permeable" medium.

Second Embodiment

Figure 11:
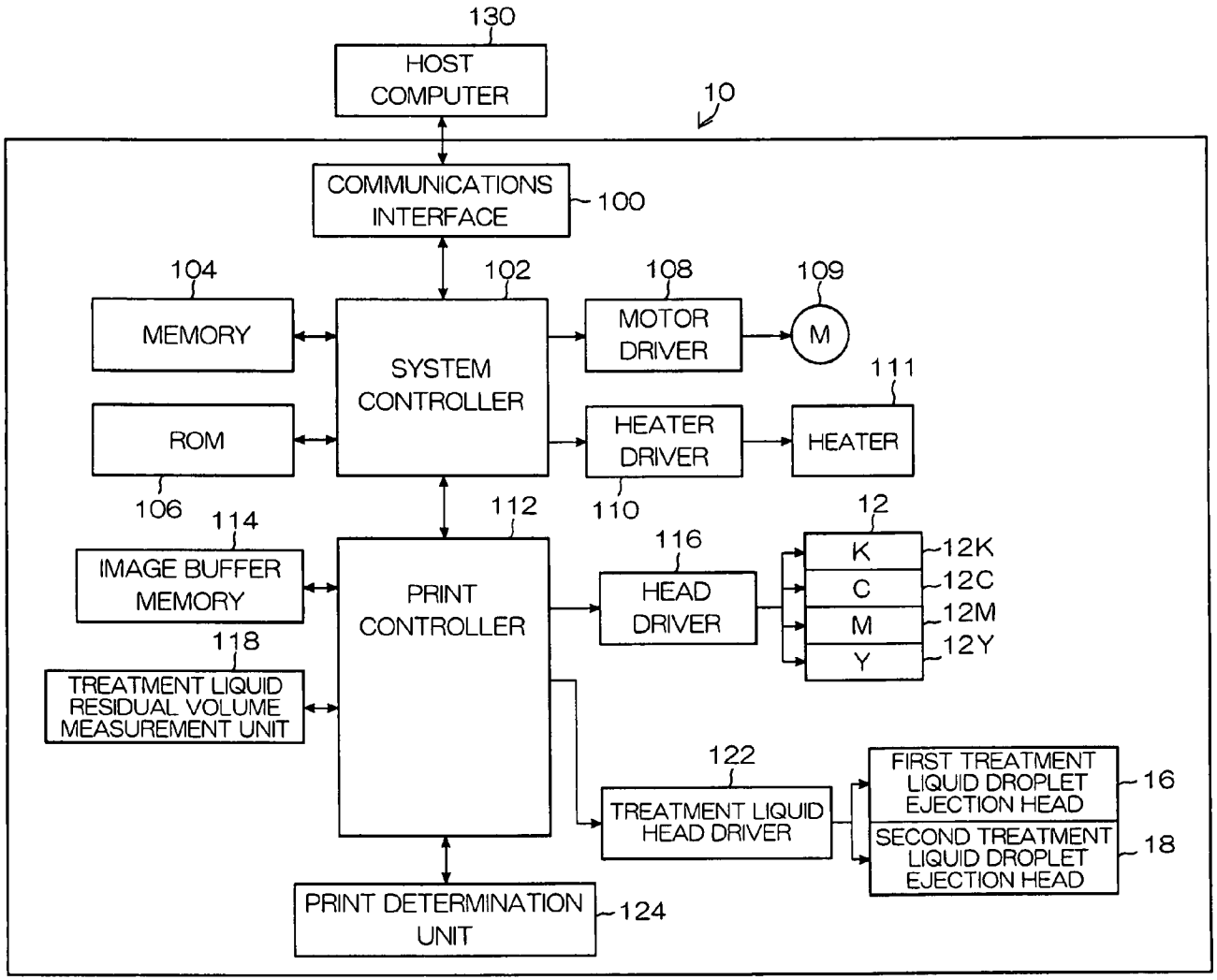
FIG. 11 is a principal block diagram showing the system configuration of the inkjet recording apparatus according to a second embodiment of the present invention.

FIG. 11 is a principal block diagram showing the system composition of an inkjet recording apparatus 200 forming a second embodiment of an image forming apparatus according to the present invention.

A treatment liquid residual volume measurement unit 118 is provided in the inkjet recording apparatus 200 according to the present embodiment, as a device for measuring the residual volume of treatment liquid on the recording medium 20.

After depositing the treatment liquid on the recording medium, the volume of treatment liquid on the recording medium 20 decreases due to the permeation of treatment liquid into the recording medium and the evaporation of treatment liquid. The treatment liquid residual volume measurement unit 118 measures the residual volume of treatment liquid which has decreased due to these causes, in other words, the volume of treatment liquid remaining as liquid on the surface of the recording medium.

In the present embodiment, the reference information for determining the ink deposition volume depending on the residual volume of treatment liquid on the recording medium, is stored in the memory 104 (for which the image buffer memory 114 may be used, instead of the memory 104).

According to the inkjet recording apparatus 200 having this composition, the print controller 112 carries out required signal processing, in accordance with the control implemented by the system controller 102, on the basis of the residual volume of treatment liquid on the recording medium as measured by the treatment liquid residual volume measurement unit 118, in such a manner that: a satisfactory image is formed on the basis of the reference information in the memory 104; and the print controller 112 controls the ink ejection volume of the print heads 12K, 12M, 12C and 12Y via the head driver 116, on the basis of the image data.

More specifically, if the residual volume per pixel of the treatment liquid of the first liquid is taken to be W1_Pixel, and the deposition volume per pixel of the ink of the second liquid is taken to be V2_Pixel, then the following relationship is established:

$$W1_Pixel < V2_Pixel \qquad \text{Formula (6)}$$

Accordingly, the ink can react in the vicinity of the surface of the recording medium 20.

Moreover, the treatment liquid 160 ejected from the treatment liquid ejection head 18 has a greater volume than the treatment liquid 154 ejected by the treatment liquid droplet ejection head 16.

Taking the deposition volume per pixel of the treatment liquid of the third liquid to be V3_Pixel, the following relationship is established:

$$W1_Pixel < V3_Pixel \qquad \text{Formula (7)}$$

Consequently, a sufficient volume of treatment liquid 160 is deposited onto the recording medium 20 after the ink 156 is deposited thereon, and hence the ink 156 can be insolubilized rapidly and completely.

According to the present embodiment, the residual volume is measured in accordance with the degree of permeation of the treatment liquid into the recording medium, and the degree of evaporation of the treatment liquid, which vary with external factors, such as the temperature and humidity during image formation, in particular.

Here, in a case where the recording medium is a permeable medium into which the ink permeates, a state in which the treatment liquid does not remain in the form of a liquid on the recording medium, in other words, a mode where all of the treatment liquid permeates into the interior of the recording medium, is described below.

More specifically, since this is a case where the residual volume per pixel of the treatment liquid of the first liquid is zero (i.e., W1_Pixel=0), then the residual volume of the treatment liquid measured by the treatment liquid residual volume measurement unit 118 is zero. In this case, if ink is deposited onto the treatment liquid which has permeated completely, then the ink can still react in the vicinity of the surface of the recording medium.

The treatment liquid residual volume measurement unit 118 having this composition is disposed on the upstream side of the print heads 12K, 12M, 12C and 12Y (before the print heads 12K, 12M, 12C and 12Y) in terms of the paper conveyance direction, for example (see FIG. 1). Desirably, the treatment liquid residual volume measurement unit 118 is disposed on the upstream side of the print heads 12K, 12M, 12C and 12Y, in terms of the paper conveyance direction, since it allows the residual volume of treatment liquid to be measured immediately before ink is deposited by the print heads 12K, 12M, 12C and 12Y.

Figure 12:
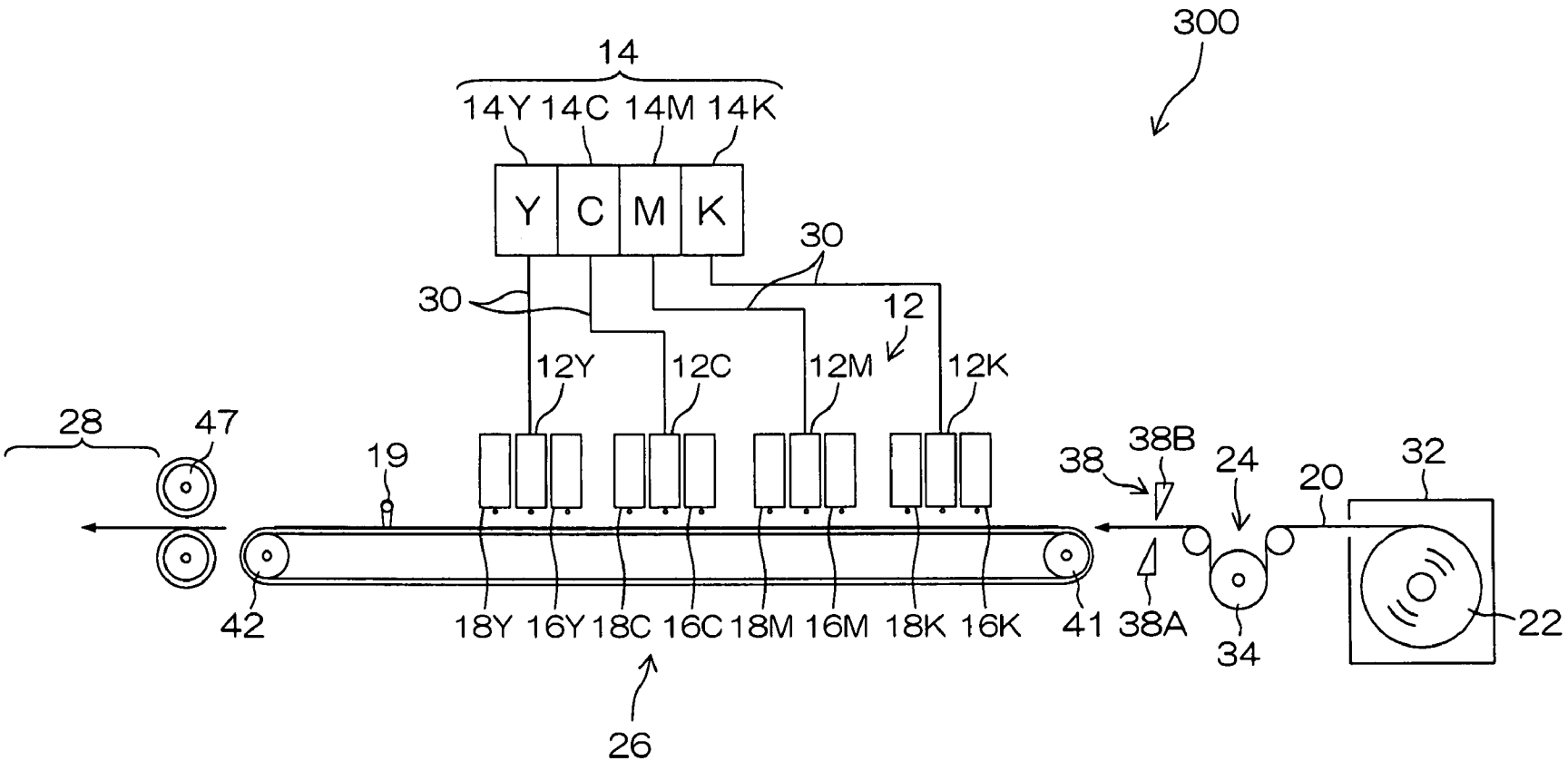
FIG. 12 is a general compositional view showing an embodiment of an inkjet recording apparatus relating to a further embodiment of the present invention.
Figure 13A:
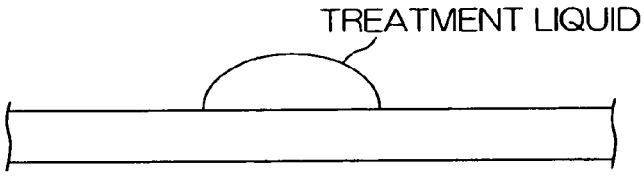
FIGS. 13A to 13C are diagrams showing the relationship between the ink and the treatment liquid in an inkjet recording apparatus of the related art, and they show a case where there is excessive treatment liquid.
Figure 13B:
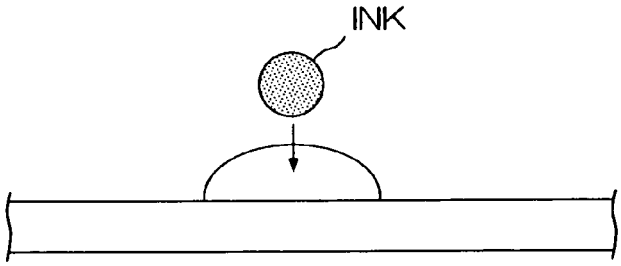
Figure 13C:
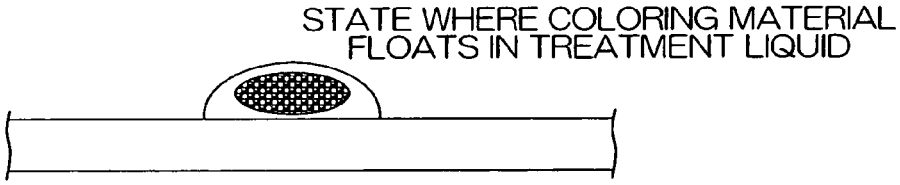
Figure 14A:
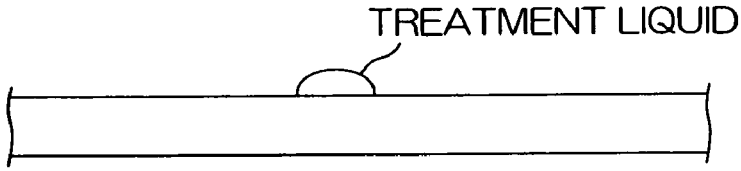
FIGS. 14A to 14C are diagrams showing the relationship between the ink and the treatment liquid in an inkjet recording apparatus of the related art, and they show a case where there is too little treatment liquid.
Figure 14B:
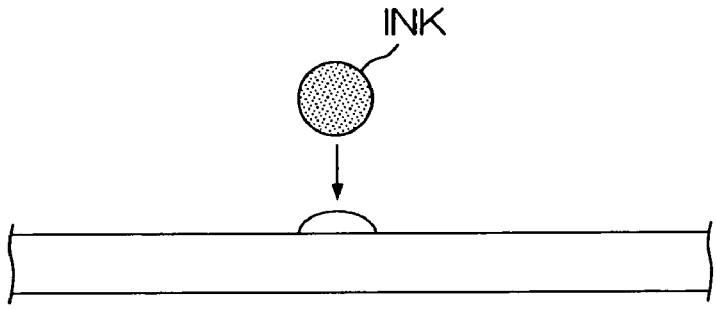
Figure 14C:
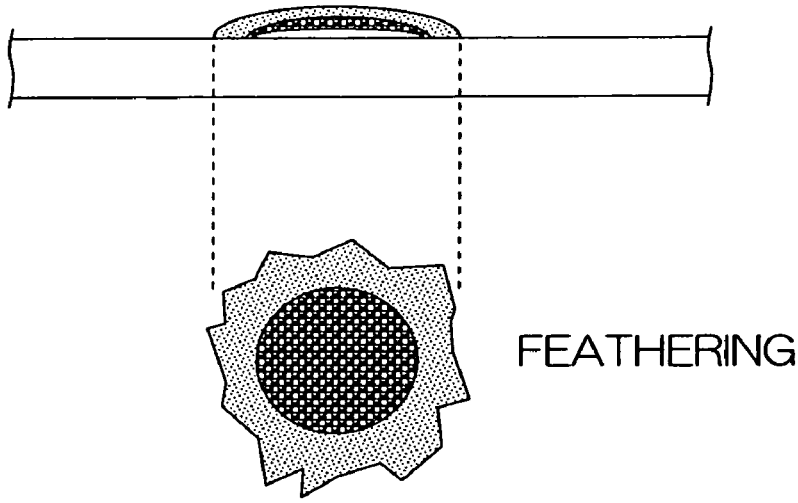

The composition of the liquid droplet ejection head described in the present embodiment is not limited to the foregoing embodiment. For example, the inkjet recording apparatus 300 shown in FIG. 12 comprises, as a means for insolubilizing the ink on the recording medium 20, treatment liquid droplet ejection heads 16K, 16M, 16C and 16Y and treatment liquid droplet ejection heads 18K, 18M, 18C and 18Y, provided respectively on the upstream side and the downstream side of the print heads 12K, 12M, 12C and 12Y (before and after the print heads 12K, 12M, 12C and 12Y) in terms of the paper conveyance direction.

These treatment liquid droplet ejection heads 16 and 18 are similar to the print heads 12K, 12M, 12C and 12Y (see FIGS. 2A to 5), and the treatment liquid is ejected from the nozzles of the treatment liquid droplet ejection heads 16 and 18 onto the recording medium 20.

Thereby, the recording medium 20 is conveyed successively on the conveyance belt 43 driven by the drive rollers 41 and 42, to a droplet ejection position where a droplet is ejected by the first treatment liquid droplet ejection head 16K, a droplet ejection position where a droplet is ejected by the first print head 12K, a droplet ejection position where a droplet is ejected by the second treatment liquid droplet ejection head 18K, a droplet ejection position where a droplet is ejected by the third treatment liquid droplet ejection head 16M, a droplet ejection position where a droplet is ejected by the second print head 12M, a droplet ejection position where a droplet is ejected by the fourth treatment liquid droplet ejection head 18M, a droplet ejection position where a droplet is ejected by the fifth treatment liquid droplet ejection head 16C, a droplet ejection position where a droplet is ejected by the third print head 12C, a droplet ejection position where a droplet is ejected by the sixth treatment liquid droplet ejection head 18C, a droplet ejection position where a droplet is ejected by the seventh treatment liquid droplet ejection head 16Y, a droplet ejection position where a droplet is ejected by the fourth print head 12Y, and a droplet ejection position where a droplet is ejected by the eighth treatment liquid droplet ejection head 18Y; and droplets of ink and treatment liquid are ejected respectively onto the recording medium 20, according to requirements. Thereupon, the recording medium 20 is conveyed to an evaporation position where evaporation is performed by the post-drying unit 19 in such a manner that the recording medium 20 is dried.

As shown in the inkjet recording apparatus 300, it is possible for the mutually adjacent treatment liquid droplet ejection heads (for example, the treatment liquid droplet ejection heads 18K and 16M, the treatment liquid droplet ejection heads 18M and 16C, or the treatment liquid droplet ejection heads 18C and 16Y) to be joined together and have an integral (common) composition.

Furthermore, it is also possible to use an image forming apparatus having a composition whereby a black and white image is formed on a recording medium, by depositing one color, such a black, onto the recording medium.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a liquid deposition device which deposits a first liquid of a treatment liquid on a recording medium initially, deposits a second liquid of an ink liquid including a coloring material on the recording medium secondly, and deposits a third liquid of a treatment liquid on the recording medium thirdly, in such a manner that the coloring material in the ink liquid is insolubilized on the recording medium and an image is formed on the recording medium; and a liquid deposition control device controlling the liquid deposition device in such a manner that a deposition volume per pixel of the first liquid, V1_Pixel, is smaller than a deposition volume per pixel of the second liquid, V2_Pixel, and a deposition surface area of the first liquid on the recording medium is greater than a deposition surface area of the second liquid on the recording medium, wherein the liquid deposition control device controls the liquid deposition device in such a manner that a deposition volume per pixel of the third liquid, V3_Pixel, is greater than the deposition volume per pixel of the first liquid, V1_Pixel.

2. An image forming apparatus, comprising:

a liquid deposition device which ejects a first liquid of a treatment liquid onto a recording medium initially, ejects a second liquid of an ink liquid including a coloring material onto the recording medium secondly, and ejects a third liquid of a treatment liquid onto the recording medium thirdly, in such a manner that the coloring material in the ink liquid is insolubilized on the recording medium and an image is formed on the recording medium; and a liquid deposition control device controlling the liquid deposition device in such a manner that a droplet ejection volume of the first liquid, V1, is smaller than a droplet ejection volume of the second liquid, V2, and a deposition surface area of the first liquid on the recording medium is greater than a deposition surface area of the second liquid on the recording medium, wherein the liquid droplet ejection control device controls the liquid deposition device in such a manner that a droplet ejection volume of the third liquid, V3, is greater than the droplet ejection volume of the first liquid, V1.

3. The image forming apparatus as defined in claim 1, wherein surface tension of the third liquid, $\gamma$3, is smaller than surface tension of the second liquid, $\gamma$2.

4. The image forming apparatus as defined in claim 2, wherein surface tension of the third liquid, $\gamma$3, is smaller than surface tension of the second liquid, $\gamma$2.

5. The image forming apparatus as defined in claim 1, wherein surface tension of the first liquid, $\gamma$1, is smaller than surface tension of the second liquid, $\gamma$2.

6. The image forming apparatus as defined in claim 2, wherein surface tension of the first liquid, $\gamma$1, is smaller than surface tension of the second liquid, $\gamma$2.

* * * * *